US005842414A

United States Patent [19]

Yoshida et al.

[11] Patent Number: 5,842,414

[45] Date of Patent: Dec. 1, 1998

[54] DIGITAL PRINTER

[75] Inventors: Takumi Yoshida; Takashi Yagi, both of Kyoto, Japan

[73] Assignee: Dainippon Screen Mfg., Co., Ltd., Japan

[21] Appl. No.: 739,866

[22] Filed: Oct. 31, 1996

[30] Foreign Application Priority Data

| | | | |
|---|---|---|---|
| Oct. 31, 1995 | [JP] | Japan | 7-283894 |
| Nov. 13, 1995 | [JP] | Japan | 7-294457 |
| Nov. 28, 1995 | [JP] | Japan | 7-309468 |

[51] Int. Cl.[6] ..... B41F 7/02

[52] U.S. Cl. ..... 101/136; 101/183; 101/216; 101/177; 101/152; 101/217

[58] Field of Search ..... 101/216, 401.1, 101/477, 450.1, 463.1, 211, 136, 152, 174, 246, 177, 282, 181, 183, 212, 141, 142, 217

[56] References Cited

U.S. PATENT DOCUMENTS

| | | | |
|---|---|---|---|
| 3,536,006 | 10/1970 | Roozee | 101/137 |
| 5,305,019 | 4/1994 | Orth et al. | 101/450.1 |
| 5,469,787 | 11/1995 | Turner et al. | 101/211 |

FOREIGN PATENT DOCUMENTS

| | | |
|---|---|---|
| 63171135 | 1/1990 | Japan . |
| 1281857 | 6/1991 | Japan . |

*Primary Examiner*—Christopher A. Bennett
*Attorney, Agent, or Firm*—Ostrolenk, Faber, Gerb & Soffen, LLP

[57] ABSTRACT

A digital printer of the present invention employs a single laser depress unit. In a prepress process, an impression cylinder is used as a plate retention member for holding four printing plates. Image formation on the four printing plates held on the impression cylinder is achieved by way of the single laser prepress unit disposed adjacent to the periphery of the impression cylinder. The printing plates thus prepressed are transported from the impression cylinder to plate cylinders. After the printing plates are mounted on the plate cylinders, a printing sheet is fed from a sheet feeding section to the impressing cylinder via a loading unit. Dampening water and color ink is applied to the plate cylinders 17 from dampening water units and inking units, respectively. The various colors of ink are respectively transferred onto blanket cylinders from the plate cylinder, and further transferred from the blanket cylinders onto the printing sheet on the impression cylinder.

32 Claims, 28 Drawing Sheets

DIGITAL PRINTER

BACKGROUND OF THE INVENTION

1. Field of the Invention

The present invention relates to a printing machine integrally incorporating a prepress mechanism and a printing mechanism. Such a printing machine, which is generally referred to as a digital printer, is capable of performing both a prepress process and a printing process.

2. Description of Prior Art

Before the advent of digital printers, the printing technology employed a prepress machine and a printing machine which served as separate entities for their respective purposes.

A conventional prepress machine employs a prepress process in which a printing plate brought into intimate contact with a film formed with a monochrome image is exposed to light and the light passing through transparent portions of the film chemically changes a photosensitive layer of the printing plate, thereby recording the image on the printing plate. This process is referred to as the "contact exposure method". The printing plate thus prepressed is manually set in a printing machine for printing.

Recently, another prepress process has been introduced in which a printing plate is formed with an image by a laser-scan exposure method or the like. That is, the prepress of the printing plate can be achieved by using digital data. This process is referred to as the "computer-to-plate method". The printing plate thus prepressed is automatically set in a printing machine for printing.

In the state-of-the-art printing technology, digital printers have been developed which integrally incorporate a prepress machine and a printing machine. Thus, the prepress process and the printing process can be performed in a single machine.

In these digital printers, a printing plate is prepressed by a laser-scan exposure method or the like on the basis of image data (digital data) prepared by DTP or the like, and the printing process is performed using the printing plate. Therefore, the prepress machine and the printing machine do not serve as separate entities. The digital printers may employ various kinds of printing plates and printing systems (ink-based system, toner-based system and the like).

One of the prior-art digital printers is QUICKMASTER DI46-4 available from HEIDERBERG PMT. The digital printer uses a polyester-based waterless lithographic printing plate and inks for printing.

FIG. 1 is a diagram illustrating a mechanism of a prior-art digital printer. The digital printer includes an impression cylinder 1, and four stations each essentially consisting of a blanket cylinder 2, a plate cylinder 3, an ink supply unit 4 all a laser prepress unit 5 and disposed around the impression cylinder 1 in a satellitic fashion. The four stations are respectively used for the prepress process and the printing process for black, cyan, magenta and yellow print colors. The digital printer operates in the following manner.

A plate blank (not shown, a printing plate which has not been subjected to light exposure) accommodated in a rolled form within each plate cylinder 3 is drawn out and wound around the plate cylinder 3. An image is formed on the plate blank wound around the plate cylinder 3 by a laser beam outputted from the laser prepress unit 5 for prepressing of a printing plate. Printing plates are respectively prepressed for the aforesaid four print colors (prepress process).

In turn, ink is supplied from each ink supply unit 4. The supplied ink is applied onto the printing plate which has been formed with an image. The ink applied onto the printing plate is transferred onto the blanket cylinder 2. On the other hand, a printing sheet fed from a sheet feeding unit 6 is held around the impression cylinder 1. The printing sheet on the impression cylinder 1 is sequentially brought into contact with the respective blanket cylinders 2 disposed in a satellitic fashion. The four inks transferred onto the respective blanket cylinders 2 are successively transferred onto the printing sheet so that the four inks are superimposed one on another. Thus, color printing is achieved (printing process).

In ordinary offset printing, dampening water is first applied onto a printing plate and then ink is applied thereon. Conversely, since the above described apparatus employs a waterless lithographic printing plate which does not require dampening water, only the ink is supplied to the printing plate.

The foregoing prior-art digital printer has such a construction where the printing plates are respectively prepressed on the plate cylinders 3. Therefore, the laser prepress units 5 need to be disposed adjacent to the respective plate cylinders 3. Further, the plate cylinders 3 each need to be provided with a plate blank cassette for accommodating the plate blank.

Therefore, the digital printer requires four laser prepress units 5 and four plate blank cassettes, presenting a problem of an increased number of components. In particular, the laser prepress units 5 are expensive, resulting in a higher price of the overall digital printer.

SUMMARY OF THE INVENTION

It is a principal object of the present invention to provide a digital printer employing a single laser prepress unit for a prepress process.

It is another object of the present invention to provide a digital printer having a simple construction with a reduced number of components.

With a view to accomplishing the above-mentioned objects, there is provided, in accordance with the present invention, a digital printer integrally incorporating a prepress mechanism and a printing mechanism and adapted to form an image on a printing plate on the basis of image data and then print on a printing sheet by using the printing plate, which digital printer includes:

- a plate cylinder for holding a printing plate in a prepress process;
- an ink supplying device for supplying a predetermined ink to the printing plate held by the plate cylinder in the printing process;
- a blanket cylinder rotatable in contact with the plate cylinder for receiving the ink transferred thereon from the printing plate in the printing process;
- an impression cylinder rotatable in contact with the blanket cylinder for transporting a printing sheet on the periphery thereof and transferring the ink from the blanket cylinder onto the printing sheet in the printing process;
- a support device for supporting an image-unrecorded printing plate in a prepress process; and
- a single prepress device for recording an image corresponding to a print color on the printing plate supported by the supporting device.

With this arrangement, the image formation on the printing plate supported by the support device is achieved by the single prepress device in the prepress process.

A laser prepress unit is, for example, usable as the prepress device. Since the image recording on a plurality of printing plates is achieved by way of the single laser prepress unit, the construction of the overall digital printer can be simplified and, in addition, the printer can be fabricated at low cost.

Where the impression cylinder is adapted to serve also as the support device, the image recording on the printing plate can be performed with the printing plate being supported by the impression cylinder in the prepress process. In a printing process, the printing plate supported by the impression cylinder is transferred to the plate cylinder, and then a printing sheet is held and transported by means of the impression cylinder. That is, the impression cylinder can be used as two different functional means, i.e., for the prepress process and for the printing process and, hence, the construction of the printer can be simplified.

Where the support device is a cylindrical prepress cylinder, the support device can be constructed as a separate component from the printing mechanism. Therefore, the prepress process on the prepress cylinder can be performed simultaneously with the printing process.

The support device may be constructed as having a predetermined transportation path instead of the cylindrical prepress cylinder. With this arrangement, the single prepress device can be easily provided in association with the transportation path as the support device, so that the fabrication and incorporation of the prepress mechanism are easy. Further, extension of the transportation path permits a plurality of printing plates to be supported on the transportation path.

Where the plate cylinder is adapted to serve also as the support device, an image-unrecorded printing plate is held by the plate cylinder, then an image is recorded on the printing plate, and the printing process is performed by using the image-recorded printing plate. Since the printing plate is held in the same state by the plate cylinder before and after the image recording on the printing plate, positional offset of the printing plate can be avoided during the prepress process and the printing process. Therefore, where a color print is made by using a plurality of color inks, registration of different color ink images can be ensured, thereby providing a beautiful print image free from a color offset.

DETAILED DESCRIPTION OF THE PREFERRED EMBODIMENTS

In a lithographic printing (offset printing), a planar printing plate is formed with oleophilic portions corresponding to image features to be printed and hydrophilic portions corresponding to non-image areas. The hydrophilic non-image portions are moistened with dampening water, while ink is applied onto the oleophilic image portions. At this The ink is immiscible with the dampening water because of a repellency therebetween, so that the ink does not adhere to the hydrophilic non-image portions. The ink applied onto the printing plate is transferred onto a blanket cylinder having a surface formed of a rubber or the like, and then transferred onto a paper sheet from the blanket cylinder for printing.

A lithographic plate has a photosensitive layer such as of a silver salt or the like, which is exposed to light corresponding to the image features to be printed and then developed and fixed for prepress of the printing plate. The digital printer according to the present invention is adapted to perform the prepress process and the printing process using the printing plate thus prepared.

Figure 1:
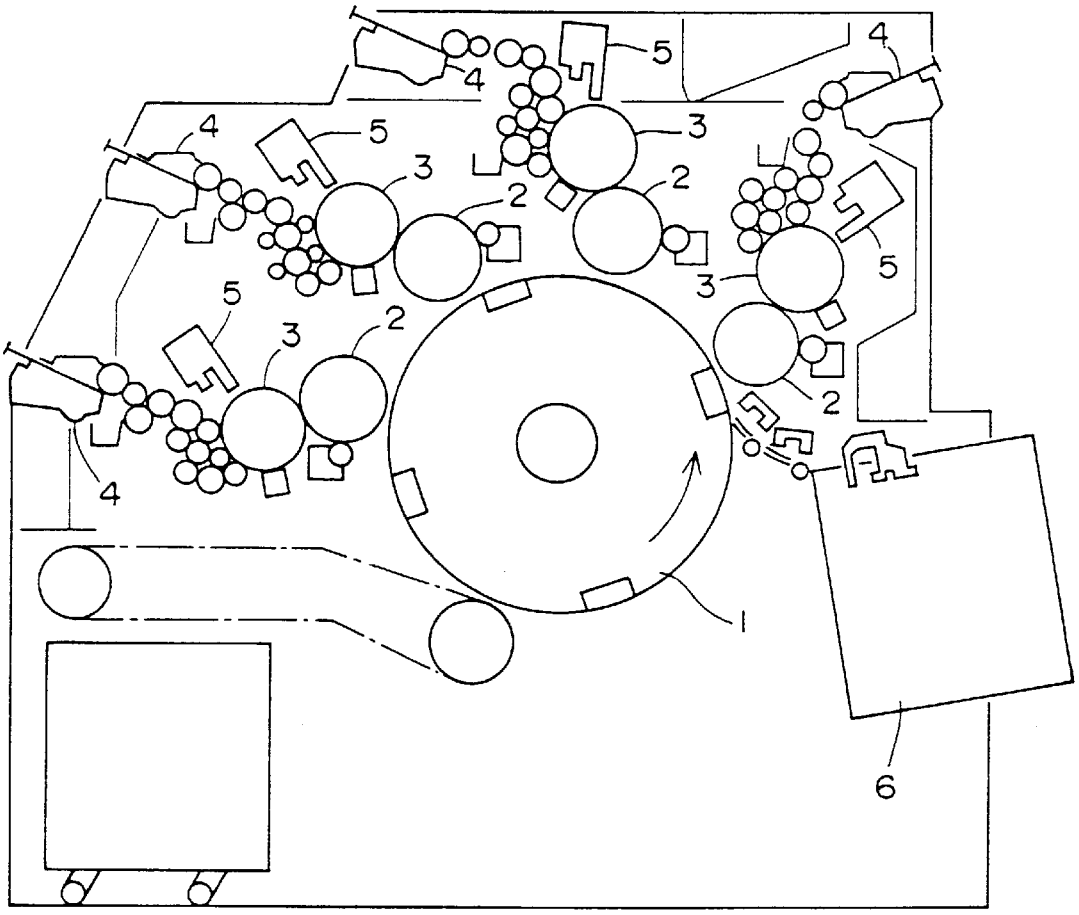
FIG. 1 PRIOR ART
FIG. 1 is a diagram illustrating a prior art digital printer.
Figure 2:
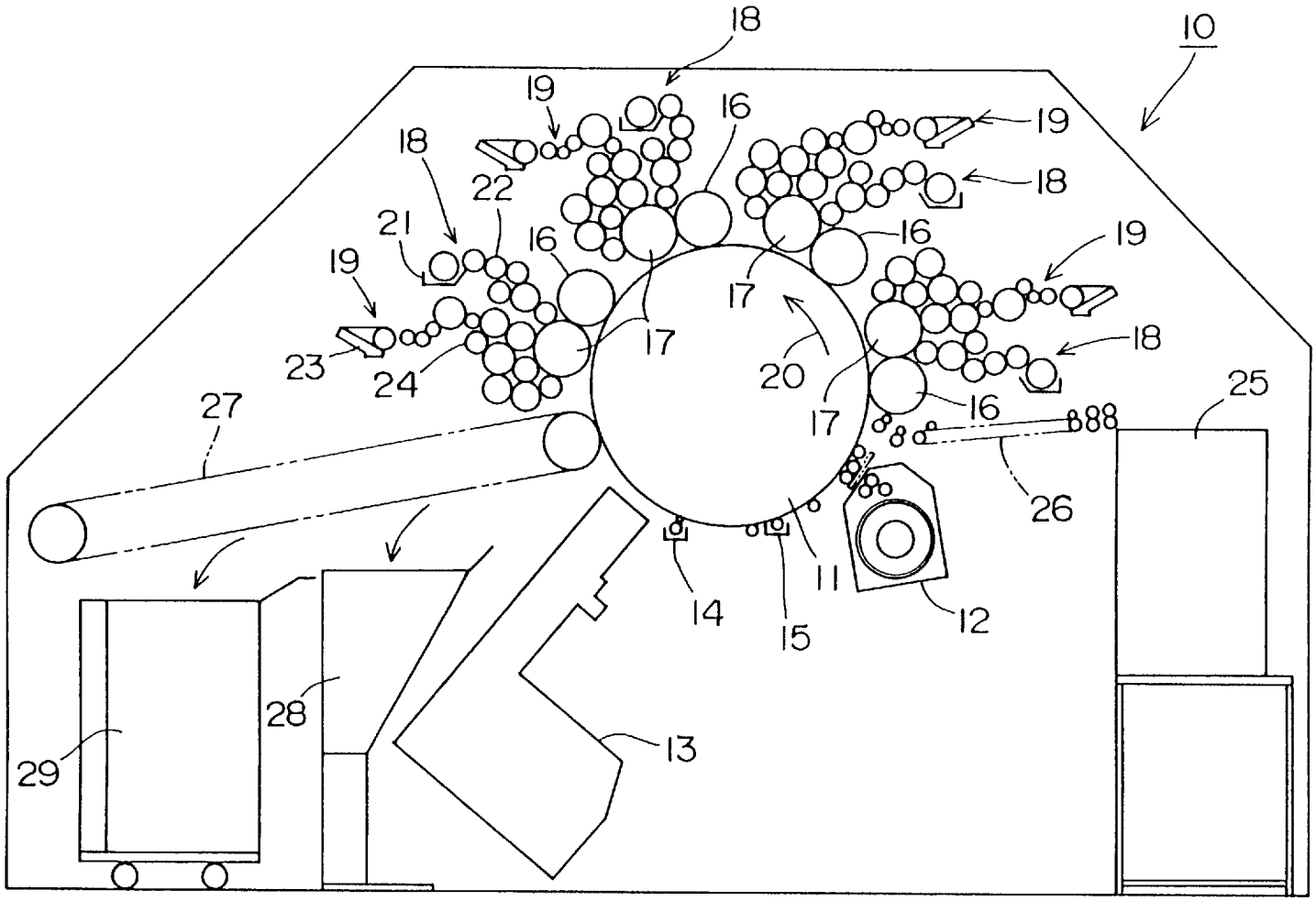
FIG. 2 is a schematic diagram illustrating a digital printer according to a first embodiment of the present invention.

FIG. 2 is a schematic diagram illustrating a digital printer 10 according to a first embodiment of the present invention. The digital printer 10 has an impression cylinder 11. The impression cylinder 11 is of an elongate cylindrical configuration extending in a direction perpendicular to the plane of FIG. 2. The periphery of the impression cylinder 11 is circumferentially divided into five peripheral regions, for example, on which printing plates or printing sheets are respectively held. The five peripheral regions of the impression cylinder 11 are respectively provided with grip claws which will be described later.

Below the impression cylinder 11 is disposed a plate blank cassette 12, a laser prepress unit 13, a developing unit 14 and a fixing unit 15 each confronting the periphery of the impression cylinder 11. The developing unit 14 and the fixing unit 15 are positioned in contact with the periphery of the impression cylinder 11 in a prepress process which will be described later, and moved to positions apart from the periphery of the impression cylinder 11 in a printing process.

Each of four printing units having a blanket cylinder 16, a plate cylinder 17, a dampening water supplying unit 18 and an inking unit 19 is disposed adjacent the periphery of the impression cylinder 11 on the upper side thereof. The four printing units respectively used for the printing of black, cyan, magenta and yellow images are disposed along the direction of rotation of the impression cylinder 11 (indicated by an arrow 20).

The blanket cylinders 16 and the plate cylinders 17 are of an elongate cylindrical configuration extending perpendicular to the plane of FIG. 2. The blanket cylinders 16 are disposed in contact with the periphery of the impression cylinder 11. The plate cylinders 17 are disposed in contact with the peripheries of the corresponding blanket cylinders 16 and adjacent to the periphery of the impression cylinder 11.

Each of the dampening water units 18 has a water container 21 and a multiplicity of water rollers 22 for supplying water from the water container 21 to the plate cylinder 17. Each of the inking units 19 has an ink container unit 23 and a multiplicity of inking rollers 24 for introducing ink from the ink container unit 23 to the plate cylinder 17. The water rollers 22 and the inking rollers 24 are of an elongate cylindrical configuration extending perpendicular to the plane of FIG. 2. The ink in the ink container unit 23 is supplied to the plate cylinder 17 not via a single path but via a plurality of paths by means of the multiplicity of inking rollers 24. By supplying the ink via the plurality of paths by means of the multiplicity of inking rollers 24, the ink can be supplied to the plate cylinder 17 without discontinuity or unevenness along the lengthwise direction of the plate cylinder 17 (perpendicular to the plane of FIG. 2) during a continuous printing operation.

The water rollers 22 and the inking rollers 24 are disposed in contact with the plate cylinder 17 on the upstream side and downstream side, respectively, along the direction of rotation of the plate cylinder 17. Therefore, non-image portions of a printing plate held on the plate cylinder 17 is first moistened with dampening water and then the ink is adhered onto image portions of the printing plate.

The digital printer 10 further includes a sheet feeding section 25 for accommodating printing sheets, a loading unit 26 for transporting a sheet taken out of the sheet feeding section 25 to the impression cylinder 11, an unloading unit 27 for receiving and transporting a printing plate held on the impression cylinder 11 or a printed sheet, a plate discharging section 28 for receiving the printing plate from the unloading unit 27, and a sheet discharging section 29 for receiving the printed sheet from the unloading unit 27.

Figure 3A:
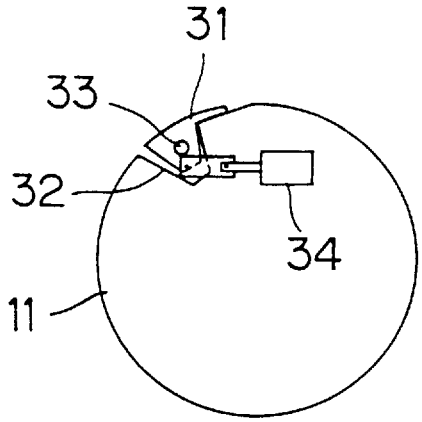
FIGS. 3A, 3B and 3C are schematic diagrams illustrating an exemplary construction of a grip claw provided in an impression cylinder.
Figure 3B:
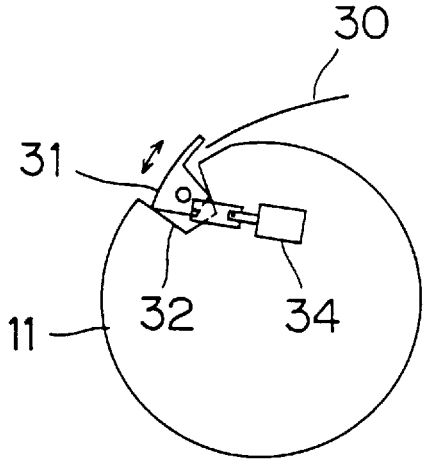
Figure 3C:
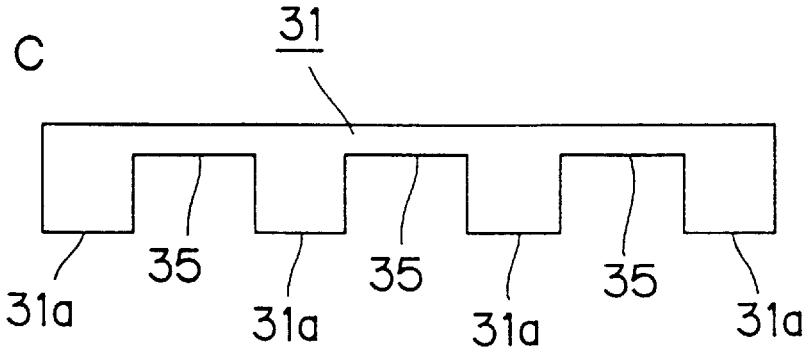

FIGS. 3A to 3C are schematic diagrams illustrating the grip claw 31 provided in the impression cylinder 11. In FIGS. 3A and 3B, the grip claw 31 is depicted as having a larger size with respect to the diameter of the impression cylinder 11 for the convenience of illustration. Although five grip claws are respectively provided in the five peripheral regions of the impression cylinder 11 in practice, only one grip claw is shown in FIGS. 3A and 3B, likewise for the convenience of illustration.

U-shaped grooves 32 extending along the axial length of the impression cylinder 11 are formed on the periphery of the impression cylinder 11. The grip claws 31 are respectively disposed in the U-shaped grooves 32 and are pivotal on pivot axes 33. The grip claws 31 are each adapted to shift between a closed state as shown in FIG. 3A and an open state as shown in FIG. 3B. When the grip claw 31 is in the open state, the printing sheet or the printing plate is inserted between the open grip claw 31 and the periphery of the impression cylinder 11. When the grip claw 31 is in the closed state, the printing sheet or the printing plate is held between claw tips 31*a* of the grip claw 31 and the periphery of the impression cylinder 11. As will be described later, the grip claws 31 are used to hold printing sheets and printing plates.

Each of the grip claws 31 is pivoted by means of a solenoid 34 provided within the impression cylinder 11. When the solenoid 34 is in an off state, the grip claw 31 is closed by means of a spring not shown. When the solenoid 34 is in an on state, the grip claw 31 is opened.

A cam, a motor or the like may be used as a mechanism for closing and opening the grip claw 31 instead of the solenoid 34.

FIG. 3C is a schematic diagram illustrating the grip claw 31 as viewed from a direction perpendicular to the axis of the impression cylinder 11. The grip claw 31 is formed with cut-away portions 35 arranged along the length thereof at predetermined intervals as shown in FIG. 3C. Portions of the grip claw 31 not formed with the cut-away portions 35 serve as the claw tips 31*a*. The provision of the cut-away portions 35 prevents a claw of a recipient component from bumping against the grip claw 31 when the leading edge portion of the printing plate or the printing sheet held by the grip claw 31 is transferred to the plate cylinder 17 or the unloading unit 27.

Figure 4A:
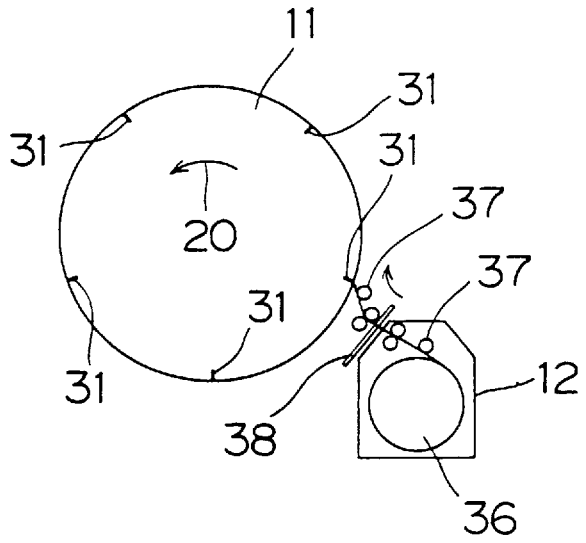
FIGS. 4A, 4B and 4C are diagrams for explaining the operations and functions of the impression cylinder, a plate blank cassette, a laser prepress unit, a developing unit and a fixing unit in a prepress process in accordance with the first embodiment of the present invention.
Figure 4B:
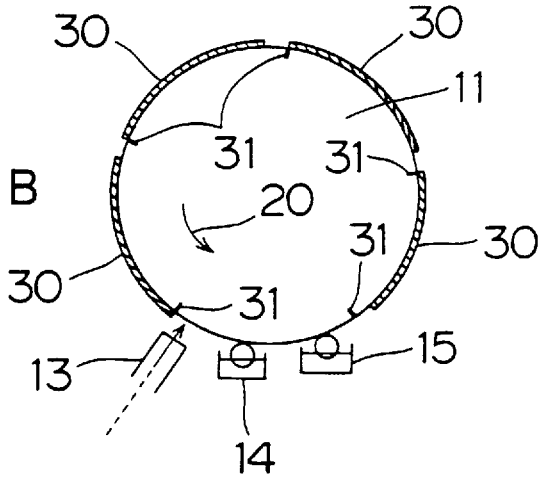
Figure 4C:
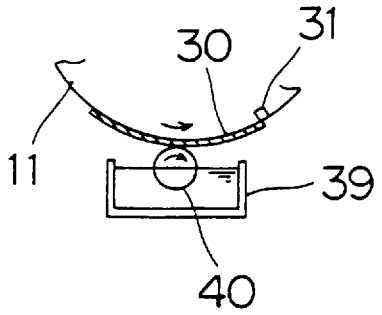

FIGS. 4A to 4C are diagrams for explaining the operations and functions of the impression cylinder 11, the plate blank cassette 12, the laser prepress unit 13, the developing unit 14 and the fixing unit 15 in the prepress process.

A rolled plate blank (a printing plate which has not been subjected to image recording) is accommodated in the plate blank cassette 12. In this embodiment, a resin sheet formed with a silver salt photosensitive layer is used as the plate blank 36. The plate blank 36 accommodated in the plate blank cassette 12 is drawn out therefrom by means of a plurality of rollers 37 provided in the plate blank cassette 12, and the leading edge portion of the plate blank 36 is then held by one grip claw 31 of the impression cylinder 11. As the impression cylinder 11 is rotated in the direction of arrow 20, the plate blank 36 is wound around the impression cylinder 11. When the plate blank 36 is drawn out by a predetermined length, a cutter 38 provided in the plate blank cassette 12 is actuated to cut the plate blank 36 to provide a printing plate 30. The trailing edge portion of the printing plate 30 is held by means of a suction mechanism (not shown) provided in the impression cylinder 11.

The aforesaid operation is repeated four times, whereby four printing plates 30 for the four print colors are mounted on the periphery of the impression cylinder 11 (see FIG. 4B).

In response to the mounting of the four printing plates 30 on the periphery of the impression cylinder 11, the developing unit 14 and the fixing unit 15 are moved to the positions in contact with the periphery of the impression cylinder 11. More specifically, the impression cylinder 11 is rotated in the direction of arrow 20 and, when the developing unit 14 and the fixing unit 15 confront one of the five peripheral regions of the impression cylinder 11 which is located forwardly adjacent to a peripheral region thereof holding a first printing plate 30, the developing unit 14 and the fixing unit 15 are brought into contact with the periphery of the impression cylinder 11 (see FIG. 4B).

As the impression cylinder 11 is further rotated in the direction of the arrow 20, images are recorded on the four printing plates 30 held on the periphery thereof by means of the laser prepress unit 13. The images recorded on the printing plates 30 are developed by the developing unit 14 and fixed on the printing plates 30 by the fixing unit 15.

Developing liquid or fixing liquid in a container 39 is removed from and applied to the printing plates 30 by means of a roller 40, as shown in FIG. 4C, in the developing unit 14 or the fixing unit 15, respectively. Thus, the development and fixation are achieved. Since the supply, discharge, replenishment, temperature control and the like of the developing liquid or the fixing liquid are not the features of the present invention and can be achieved by known methods, no explanation is presented herein.

The image recording on the printing plates 30 is thus achieved to complete the prepress process. The printing plates 30 subjected to the prepress process are transported from the impression cylinder 11 to the printing cylinder 17, as will be described later.

It should be noted that the developing unit 14 and the fixing unit 15 are moved to the position apart from the periphery of the impression cylinder 11 upon completion of the prepress process.

Figure 5:
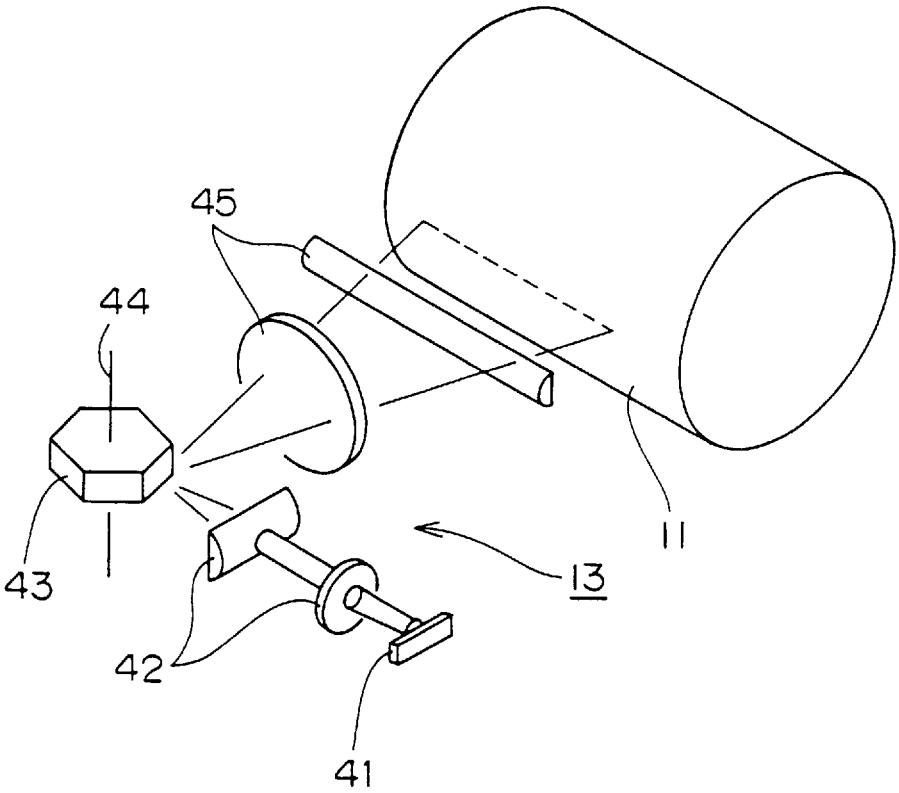
FIG. 5 is a diagram illustrating an exemplary construction of the laser prepress unit for exposing a printing plate to light in the prepress process.

FIG. 5 is a diagram illustrating an exemplary construction of the laser prepress unit 13 for exposing the printing plate 30 to light in the prepress process. The laser prepress unit 13 used in this embodiment is adapted to form an image on the printing plate 30 by scanning a laser beam along a main scanning direction.

Referring to FIG. 5, the laser prepress unit 13 has a semiconductor laser 41, a set of lenses 42 for guiding light emitted from the semiconductor laser 41 and converging the light in a predetermined state, and a polygon mirror 43 for scanning the light applied via the lens set 42 along the main scanning direction on a line-by-line basis. The polygon mirror 43 is a polygonal body adapted to be rotated at a constant rate on a rotational axis 44 thereof and having mirror surfaces on the side faces thereof. The light reflected by each of the side faces of the polygon mirror 43 serves as a scanning light beam which is used to form one line of the image. The printing plate (not shown) held on the periphery of the impression cylinder 11 is exposed to the scanning light beam reflected by the polygon mirror 43 and guided thereto by a set of lenses 45.

Since such a construction of the laser prepress unit 13 is known to the art, no detailed explanation is presented herein.

FIGS. 6A to 6E are schematic diagrams illustrating a process for transporting the prepared printing plate 30 from the impression cylinder 11 to the plate cylinder 17. The printing plate 30 on the impression cylinder 11 is transported to the plate cylinder 17 via the blanket cylinder 16, and then wound around the plate cylinder 17 (see FIG. 6A).

The impression cylinder 11 has a circumference five times longer than that of the blanket cylinder 16. When one grip claw 31 of the impression cylinder 11 confronts a predetermined blanket cylinder 16, a plurality of suction elements 51 of the blanket cylinder 16 are positioned so as to confront the grip claw 31. The blanket cylinder 16 has a circumference equivalent to that of the plate cylinder 17. When the blanket cylinder 16 is rotated to such a position that the suction elements 51 confront the plate cylinder 17, a grip unit 52 (which will be described later) of the plate cylinder 17 confronts the suckers 51.

Figure 6A:
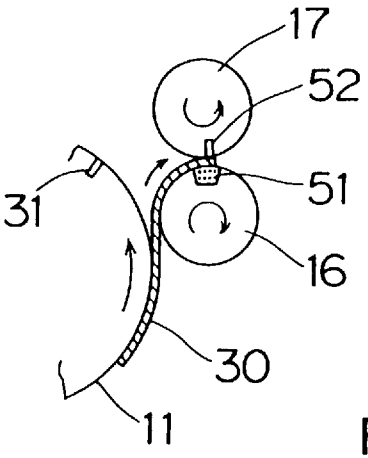
FIGS. 6A, 6B, 6C, 6D and 6E are schematic diagrams illustrating a process for transporting the printing plate prepressed on the impression cylinder from the impression cylinder to a plate cylinder.
Figure 6B:
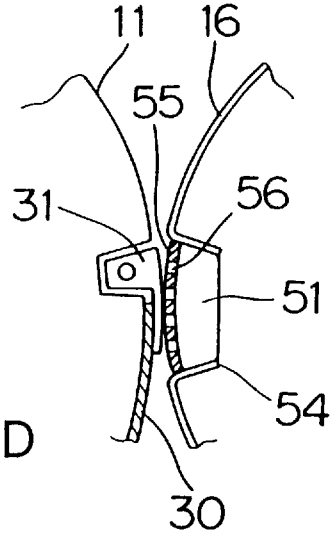

The suction elements 51 of the blanket cylinder 16 are disposed in a gap formed in the periphery of the blanket cylinder 16 as shown in FIG. 6B.

Figure 6C:
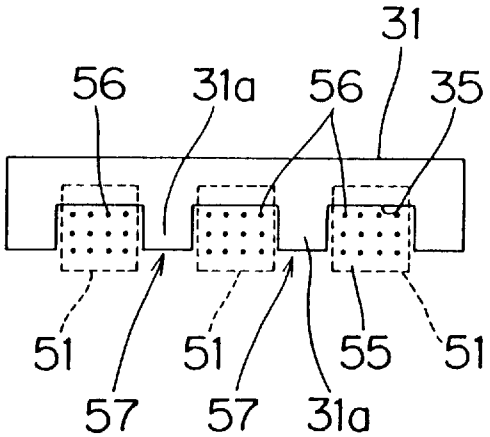

More specifically, as shown in FIGS. 6B and 6C, the blanket cylinder 16 has a gap portion 54 extending along the axial length thereof. The gap portion 54 is defined by a groove indented from the periphery of the blanket cylinder 16 and extending parallel to the axis thereof. The plurality of suction elements 51 are aligned at predetermined intervals along the axial length of the blanket cylinder 16 in the gap portion 54. The surfaces of the suction elements 51 are substantially flush with the periphery of the blanket cylinder 16. The suction elements 51 have a multiplicity of suction holes 56 formed on the surfaces 55 thereof. The suction holes 56 are connected to a vacuum pump not shown via pipe lines provided in the blanket cylinder 16. A sheet material confronting the surfaces 55 of the suction elements 51 is drawn onto the surfaces 55 by suction from the suction holes 56.

Parts of the gap portion 54 not provided with the suction elements 51 define recesses 57. The respective recesses 57 are located to confront the claw tips 31a of the grip claw 31 of the impression cylinder 11, while the suction elements 51 are located near the cut-away portions 35 of the grip claw 31.

The claw tips 31a of the grip claw 31 are insertable into the recesses 57 in the gap portion 54. Therefore, when the grip claw 31 is opened, the claw tips 31*a* can be prevented from bumping against the suction elements 51 and the like (see FIG. 6C).

Figure 6D:
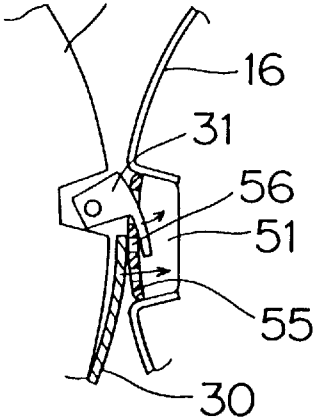

When the grip claw 31 holding the leading edge of the printing plate 30 confronts the suction elements 51, the grip claw 31 is opened and, at the same time, the leading edge of the printing plate 30 is drawn by the suction elements 51 and transferred from the impression cylinder 11 to the blanket cylinder 16 (see FIG. 6D).

Figure 6E:
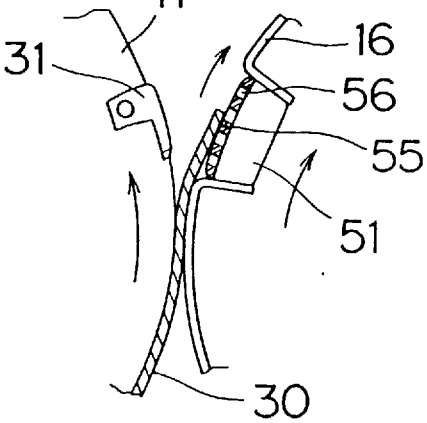

As the impression cylinder 11 and the blanket cylinder 16 are further rotated, the rest of the printing plate 30 is transferred along the periphery of the blanket cylinder 16 because the leading edge of the printing plate 30 has been transferred to the blanket cylinder 16 (see FIG. 6E).

Figure 7A:
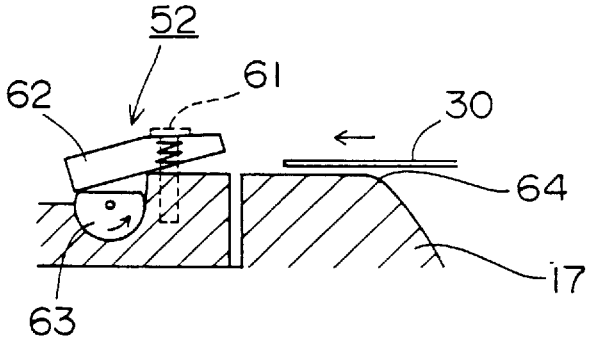
FIGS. 7A, 7B and 7C are schematic diagrams illustrating an exemplary construction of a grip unit provided in the plate cylinder.
Figure 7B:
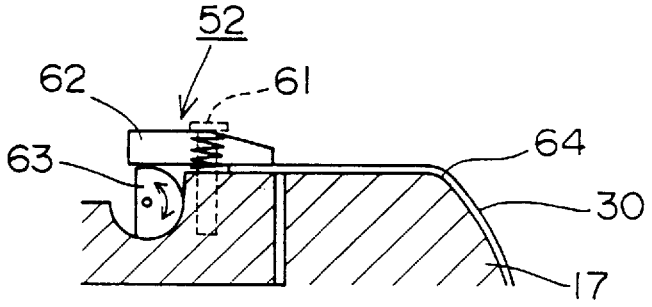
Figure 7C:
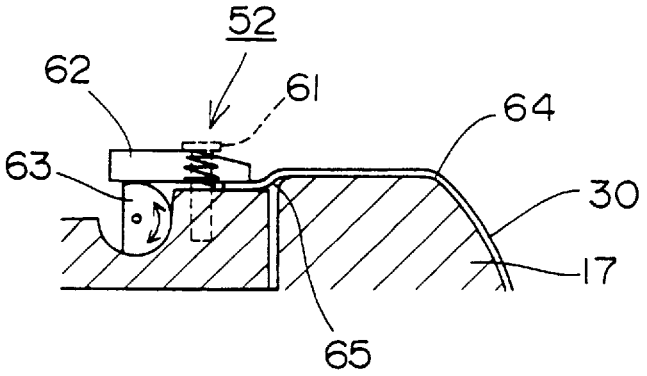

FIGS. 7A to 7C are schematic diagrams illustrating an exemplary construction of the grip unit 52 provided in the plate cylinder 17. As shown in FIGS. 7A and 7B, the grip unit 52 has a clamp 62 pivotally supported by a spring bolt 61 on the plate cylinder 17, and a cam 63 for operating the clamp 62. When the cam 63 assumes a state as shown in FIG. 7A, the clamp 62 is opened to receive the leading edge of the printing plate 30. When the cam 63 is pivoted as shown in FIG. 7B, the clamp 62 is closed to firmly hold the leading edge of the printing plate 30.

The plate cylinder 17 has a convex portion 64 formed adjacent to the grip unit 52 on the periphery thereof and having a smaller curvature than the other peripheral region thereof. The provision of the convex portion 64 permits the printing plate 30 to be held on the plate cylinder 17 with more stability.

The grip unit 52 may have a construction as shown in FIG. 7C. The grip unit 52 of FIG. 7C has a step 65 provided slightly below the circumferential level of the plate cylinder 17 in a position where the printing plate 30 is held by the clamp 62. The provision of the step 65 permits the leading edge of the printing plate 30 to be held by the clamp 62 more firmly.

Figure 8A:
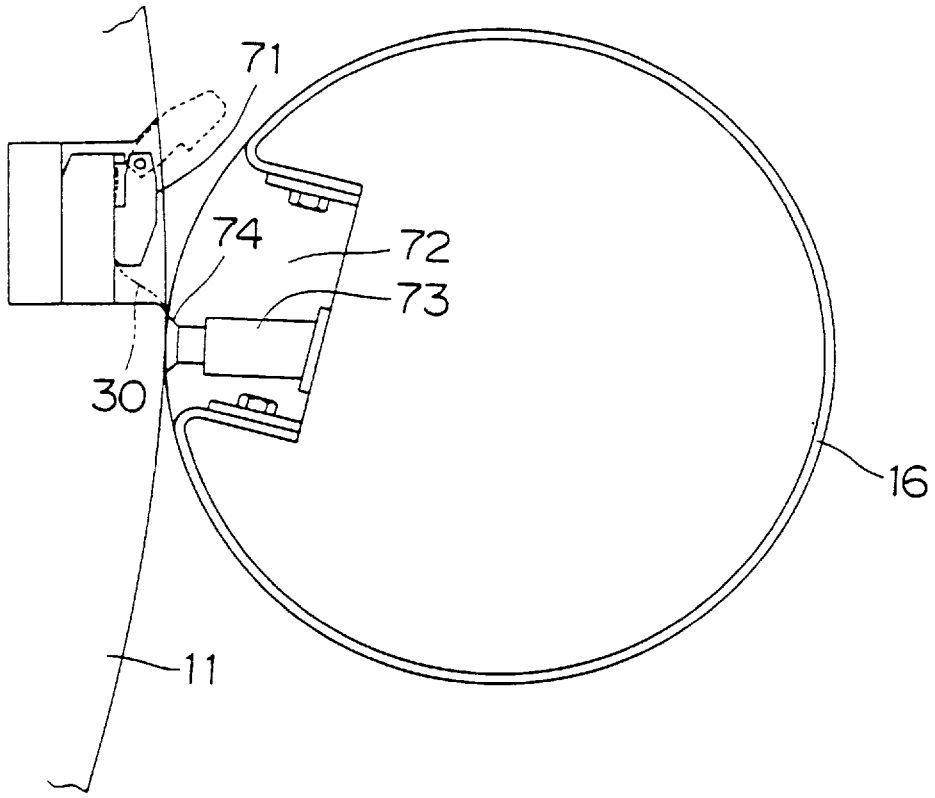
FIGS. 8A and 8B are diagrams for explaining a process for transferring the printing plate from the impression cylinder to a blanket cylinder, a process for transferring the printing plate from the blanket cylinder to the plate cylinder, and another exemplary construction of a retention mechanism for holding the printing plate or the like on the impression cylinder, the blanket cylinder or the plate cylinder.
Figure 8B:
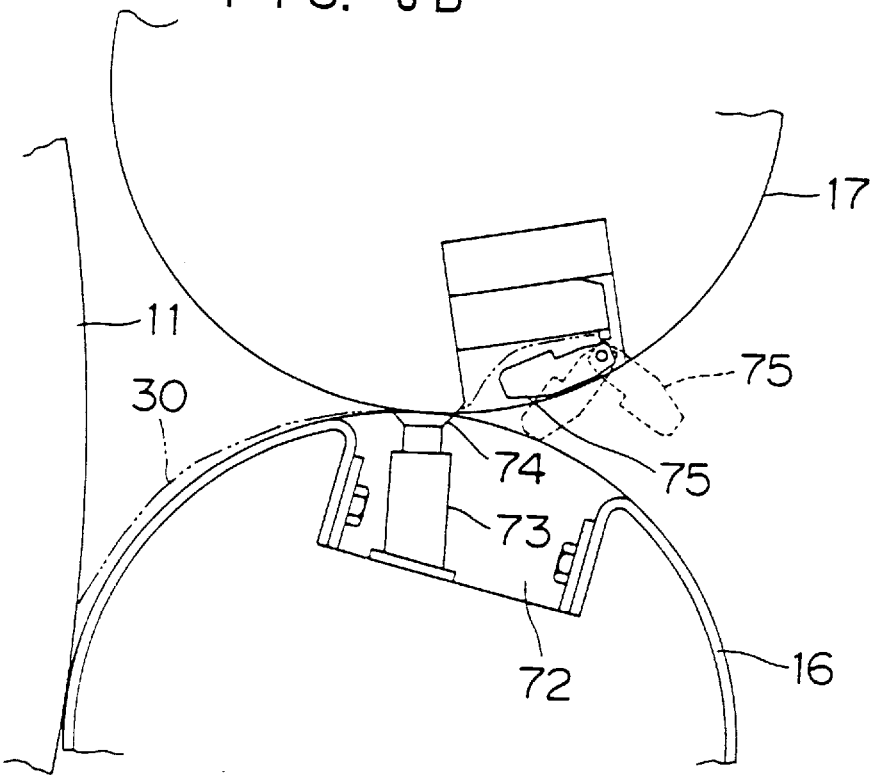

FIGS. 8A and 8B are diagrams for explaining a process for transferring the printing plate 30 from the impression cylinder 11 to the blanket cylinder 16, a process for transferring the printing plate 30 from the blanket cylinder 16 to the plate cylinder 17, and another exemplary construction of a retention mechanism for holding the printing plate 30 or the like on the impression cylinder 11, the blanket cylinder 16 and the plate cylinder 17. The impression cylinder 11 has a clamp 71 for holding the leading edge of the printing plate 30. The clamp 71 is adapted to shift between a closed state indicated by solid line and an open state indicated by dashed line. When assuming the closed state, the clamp 71 is positioned not to project from the periphery of the impression cylinder 11. Therefore, during the prepress process as described in the foregoing, there is an advantage that the roller 40 of the developing unit 14 or the fixing unit 15 does not catch on the clamp 71 since the clamp 71 is in the closed state. There is also the same advantage when the impression cylinder 11 is being cleaned.

The blanket cylinder 16 has an indentation 72 formed in a predetermined position on the periphery thereof. The indentation 72 extends along the length of the blanket cylinder 16. A plurality of suction pipes 73 are provided within and along the indentation 72. A suction port 74 provided at the tip of the suction pipe 73 is flush with the periphery of the blanket cylinder 16. The suction pipe 73 is connected to a vacuum pump not shown via a pipe line in the blanket cylinder 16.

As shown in FIG. 8A, the rotation of the impression cylinder 11 and the blanket cylinder 16 is momentarily stopped with the clamp 71 of the impression cylinder 11 confronting the indentation 72 formed in the blanket cylinder 16 for suction by the suction pipe 73. The printing plate 30 held on the periphery of the impression cylinder 11 is engaged by the suction port 74. Subsequently to the suction (or simultaneously with the suction), the clamp 71 is shifted from the closed state indicated by the solid line to the open state indicated by the dashed line. Thus, the leading edge of the printing plate 30 held on the impression cylinder 11 is transferred to the blanket cylinder 16.

The blanket cylinder 16 is rotated clockwise in this state, so that the indentation 72 of the blanket cylinder 16 is brought in confrontation to the plate cylinder 17.

As shown in FIG. 8B, the plate cylinder 17 has a clamp 75. The clamp 75 is adapted to shift between a closed state and an open state. When assuming the closed state, the clamp 75 is positioned not to project from the periphery of the plate cylinder 17. Accordingly, when a cleaning of the plate cylinder 17 is performed, for example, cleaning elements do not catch on the clamp 75 which is in the close state. When the indentation 72 of the blanket cylinder 16 confronts the plate cylinder 17, the clamp 75 of the plate cylinder 17 is positioned so as to confront the indentation 72. At this time, the clamp 75 assumes the open state, so that the leading edge of the printing plate 30 being transported by the suction port 74 of the blanket cylinder 16 enters the lower side of the clamp 75 of the plate cylinder 17. In turn, the clamp 75 is closed, and the leading edge of the printing plate 30 is held by the clamp 75. Subsequently, or simultaneously, the suction of the printing plate 30 by the suction pipe 73 is stopped. The blanket cylinder 16 is rotated clockwise, while the plate cylinder 17 is rotated counterclockwise. By one turn of the plate cylinder 17, the printing plate 30 is wound around the plate cylinder 17 and held on the periphery thereof.

Though not shown, at least the trailing edge of the printing plate 30 wound around the plate cylinder 17 is held by means of a suction device (not shown) provided in the plate cylinder 17.

Figure 9A:
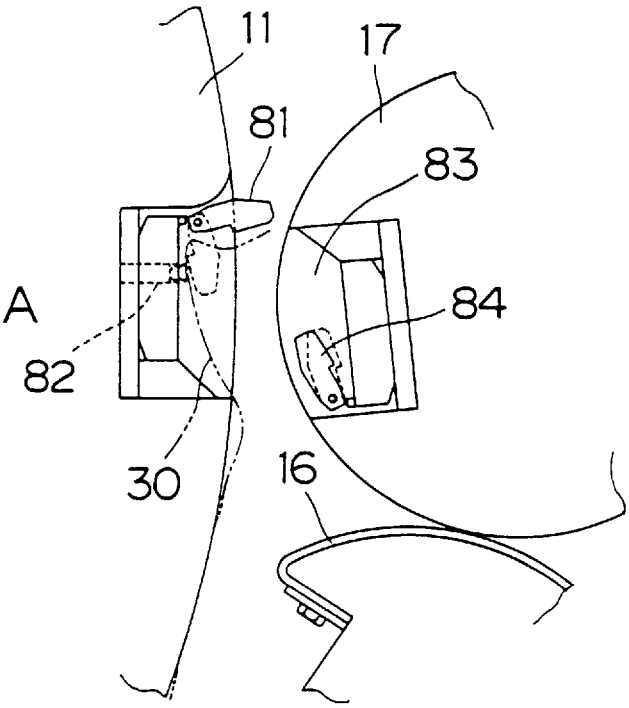
FIGS. 9A and 9B are diagrams for explaining another process and mechanism for transporting the printing plate from the impression cylinder to the plate cylinder.
Figure 9B:
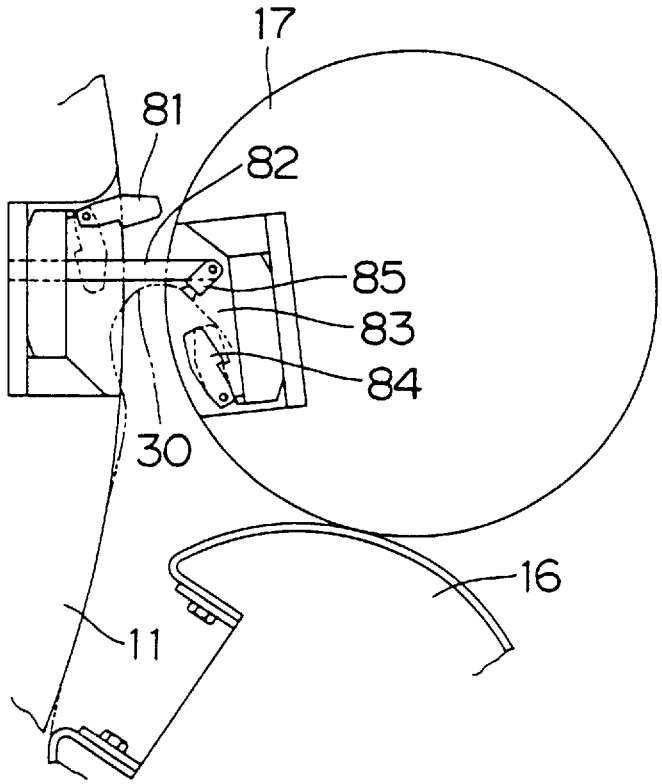

FIGS. 9A and 9B are diagrams for explaining another process and mechanism for transporting the printing plate 30 held on the impression cylinder 11 to the plate cylinder 17. The transportation mechanism and process shown in FIGS. 9A and 9B are adapted to transport the printing plate 30 directly from the impression cylinder 11 to the plate cylinder 17. That is, the construction shown in FIGS. 9A and 9B is characterized in that the printing plate 30 held on the impression cylinder 11 is not transported via the blanket cylinder 16 but directly to the plate cylinder 17.

Referring to FIG. 9A, the impression cylinder 11 has a clamp 81. The clamp 81 is adapted to shift between an open state and a closed state. When assuming the closed state, the clamp 81 is positioned so as not to project from the periphery of the impression cylinder 11. The leading edge of the printing plate 30 is held by the clamp 81 of the impression cylinder 11, in a example, in such a manner that the printing plate 30 is bent for 180-degree reversion relationship. Alternatively, the printing plate 30 is held by the clamp 81 with the leading edge thereof fully inserted to strike the base portion of the clamp 81. This is because a suction pipe 82 (which will next be described) should be positioned slightly inward from the leading edge of the printing plate 30 for providing suction thereto.

The impression cylinder 11 has the suction pipe 82. The suction pipe 82 is embedded in the impression cylinder 11 so as to confront the back side of the printing plate 30 held by the clamp 81.

The plate cylinder 17 has an indentation 83, in which a clamp 84 adapted to shift between an open state and a closed state is provided. When the clamp 81 of the impression cylinder 11 faces the clamp 84 of the plate cylinder 17 in a predetermined positional relation, the rotation of the impression cylinder 11 and the plate cylinder 17 is momentarily stopped, and the suction pipe 82 engages the back surface of the printing plate 30. Then, the clamp 81 is opened.

In this state, the suction pipe 82 projects outwardly from the impression cylinder 11 to cross the periphery thereof as shown in FIG. 9B, and then enters the indentation 83 formed in the plate cylinder 17. A suction port 85 provided at the tip of the suction pipe 82 is turned in a direction opposite to the projecting direction of the suction pipe 82. Thus, the leading edge of the printing plate 30 held by suction by means of the suction port 85 is inserted into the lower side of the clamp 84 of the plate cylinder 17. Then, the clamp 84 is closed. Thus, the leading edge of the printing plate 30 is held by the clamp 84.

In turn, the suction of the printing plate 30 by the suction port 85 is stopped, and the suction pipe 82 is retracted to be accommodated in the impression cylinder 11 as shown in FIG. 9A. Then, the clamp 81 is closed.

The plate cylinder 17 is rotated counterclockwise, whereby the printing plate 30 is wound around the plate cylinder 17.

As described above, the suction port 85 provided at the tip of the suction pipe 82 is turned in the direction opposite to the projecting direction of the suction pipe 82. This allows the printing plate 30 to be wound around the plate cylinder 17 with an image-formed surface thereof facing outward.

With the aforesaid construction, the printing plate 30 held on the impression cylinder 11 can be transported not via the blanket cylinder 16 but directly to the plate cylinder 17.

It should be noted that the clamp 71 or 81 of the impression cylinder 11 is used not only to hold the leading edge of the printing plate 30 but also to hold the leading edge of a printing sheet in a printing process which will be described later.

In the foregoing explanation, when the printing plate 30 is transferred from the impression cylinder 11 to the blanket cylinder 16, the rotation of the impression cylinder 11 and the blanket cylinder 16 is momentarily stopped with the clamp 71 of the impression cylinder 11 confronting the indentation 72 of the blanket cylinder 16.

Likewise, when the printing plate 30 is transferred from the blanket cylinder 16 to the plate cylinder 17, the rotation of the blanket cylinder 16 and the plate cylinder 17 is momentarily stopped and thereafter resumed.

By momentarily stopping the rotation of the respective cylinders for the transfer of the printing plate 30 from the impression cylinder 11 to the blanket cylinder 16 or from the blanket cylinder 16 to the plate cylinder 17, more reliable transfer of the printing plate 30 can be ensured.

However, it should be noted that the stopping of the rotation of the respective cylinders is not necessarily required for the transfer of the printing plate. The transfer can be achieved without stopping the rotation of the cylinders by properly modifying the constructions of the clamps, suction pipes and the like.

There will next be described the printing process to be performed by the digital printer 10 according to this embodiment.

Figure 10:
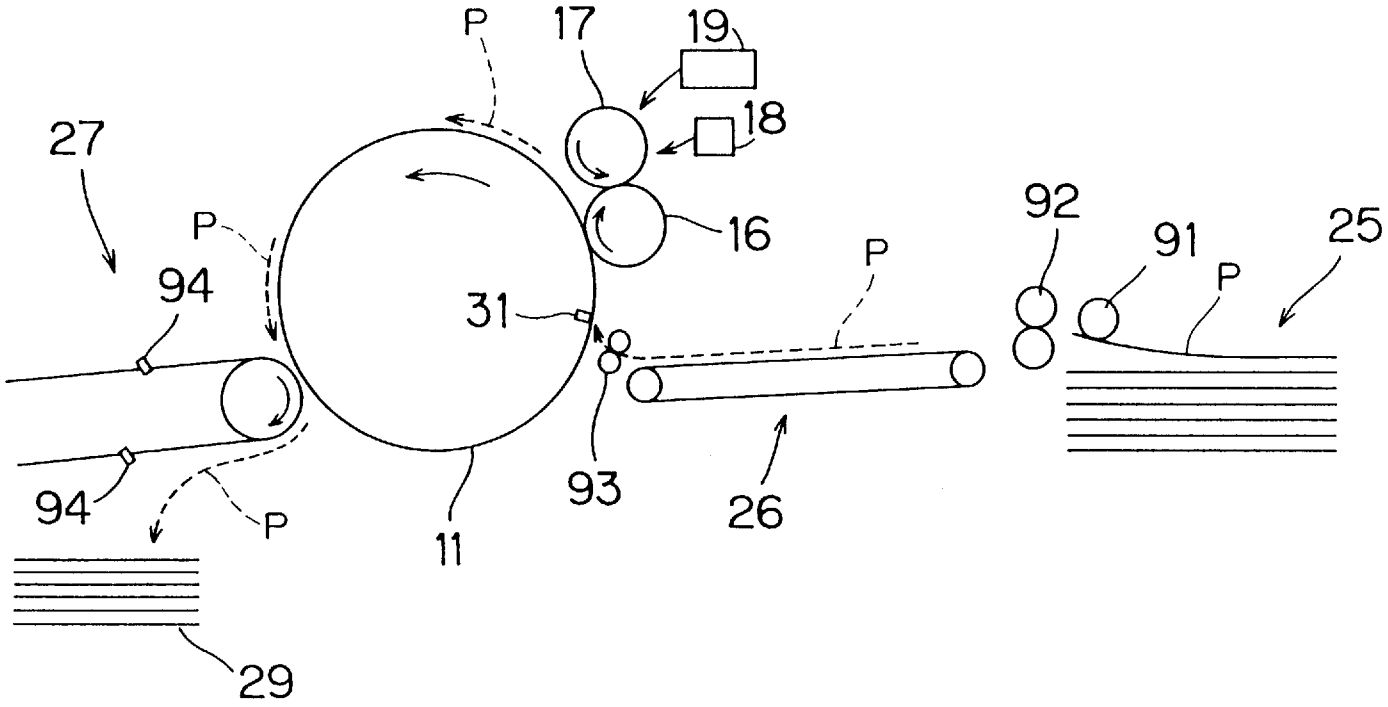
FIG. 10 is a schematic diagram for explaining operations in a printing process.

FIG. 10 is a schematic diagram for explaining operations performed in the printing process. When the printing process is started, the four plate cylinders 17 (see FIG. 2) respectively have printing plates wound therearound. The dampening water and the predetermined color ink are supplied to the printing plates from the dampening water units 18 and from the inking units 19, respectively. More specifically, the black, cyan, magenta and yellow ink are supplied to the respective printing units disposed along the direction of the rotation of the impression cylinder 11 as indicated by the arrow 20 in FIG. 2.

Referring to FIG. 10, printing sheets P accommodated in the sheet feeding section 25 are successively taken out by means of a sheet feeding mechanism including a take-out roller 91 and separation rollers 92, and then transported to the loading unit 26. The loading unit 26 transports the printing sheets P one by one to the impression cylinder 11. At the downstream end of the loading unit 26 along a sheet transportation direction are provided timing rollers 93 for adjusting the timing for feeding a printing sheet to the impression cylinder 11. When the grip claw 31 of the impression cylinder 11 comes to a position for holding the leading edge of the printing sheet P, the printing sheet P is fed to the impression cylinder 11 by means of the timing rollers 93, and the grip claw 31 holds the leading edge of the printing sheet P.

The impression cylinder 11 is rotated with the grip claw 31 thereof holding the leading edge of the printing sheet P to hold the printing sheet P on the periphery thereof. Thus, the printing sheet P held on the impression cylinder 11 is sequentially brought in contact with the four blanket cylinders 16.

The plate cylinders 17 are respectively supplied with the dampening water from the dampening water units 18 and with the ink from the inking units 19. The colored ink is respectively applied onto the printing plates held on the peripheries of the corresponding plate cylinders 17 in accordance with images formed thereon. The inks applied onto the printing plates on the plate cylinders are respectively transferred onto the corresponding blanket cylinders 16. Then, the ink transferred onto the peripheries of the corresponding blanket cylinders 16 are transferred onto the printing sheet P held on the impression cylinder 11.

As the impression cylinder 11 rotates to bring the printing sheet P into contact with the four blanket cylinders 16, the black, cyan, magenta and yellow ink is transferred and superimposed one on another on the printing sheet P, thereby achieving color printing.

When the impression cylinder 11 makes approximately two thirds of a turn, the four colors of ink are transferred onto the printing sheet P held on the impression cylinder 11. Thus, the printing is completed. When the printed sheet P comes to a position confronting the unloading unit 27, the leading edge of the sheet P is held by grippers 94 of the unloading unit 27, and the grip claw 31 of the impression cylinder 11 is opened. Thus, the printed sheet P is transferred from the impression cylinder 11 to the unloading unit 27. The grippers 94 of the unloading unit 27 hold the leading edge of the printed sheet P to transport the sheet P. When the sheet P is transported to the sheet discharging section 29, the grippers 94 are opened, and the sheet P is placed in the sheet discharging section 29.

Figure 11A:
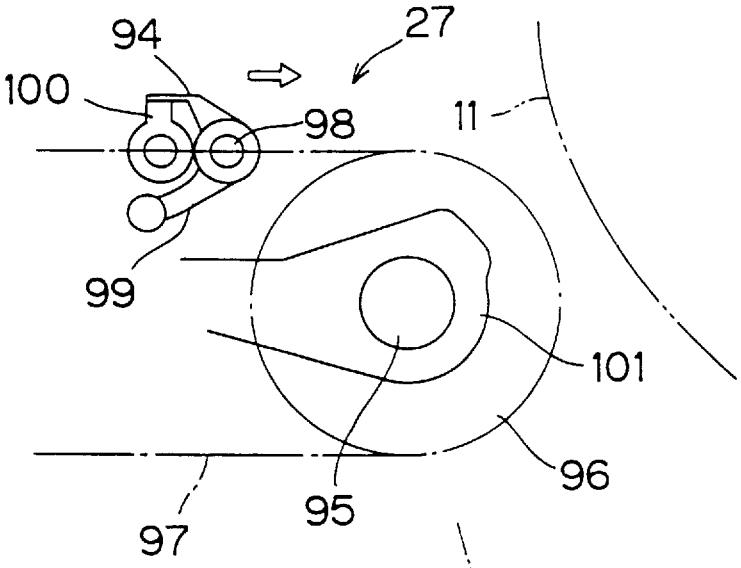
FIGS. 11A, 11B and 11C are diagrams for explaining a gripper open/close mechanism provided in an unloading unit.
Figure 11B:
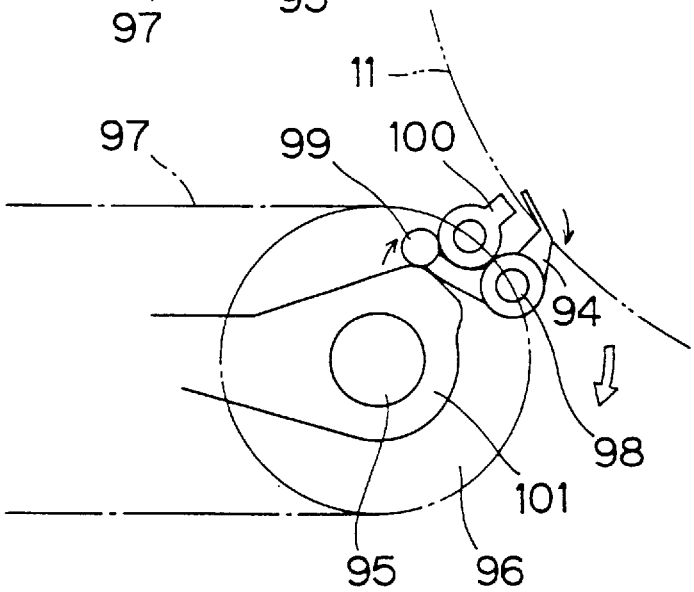
Figure 11C:
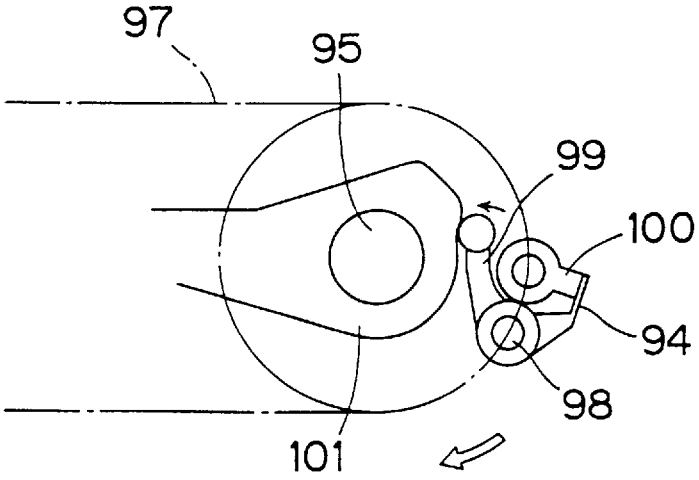

FIGS. 11A to 11C are diagrams for explaining an open/close mechanism of the grippers 94 provided in the unloading unit 27.

As shown in FIG. 11A, the unloading unit 27 has a chain gear 96 rotatable on a rotation shaft 95. Chains 97 are wound around the chain gear 96. The grippers 94 are provided at predetermined positions of the chains 97. More specifically, each of the grippers 94 is attached to a gripper rotation shaft 98 fixed to the chains 97. The grippers 94 are respectively coupled to cam followers 99. The grippers 94 and the cam followers 99 are rotatable on the gripper rotation shaft 98.

A gripper base 100 is provided adjacent to the grippers 94. The gripper base 100, when the grippers 94 are rotated counterclockwise, receives the grippers 94 to close the grippers 94.

Each of the grippers 94 is biased counterclockwise by a spring not shown so as to be kept in a closed state.

The unloading unit 27 further includes a cam plate 101. The cam plate 101 is brought into contact with the cam followers 99 to operate the cam followers 99 when the chains 97 are moved to rotate the cam followers 99 on the rotation shaft 95.

More specifically, when the grippers 94 come to positions adjacent the periphery of the impression cylinder 11 to as shown in FIG. 11B, the cam plate 101 raises the cam followers 99 to rotate the grippers 94 clockwise, whereby the grippers 94 are opened. After the grippers 94 pass the adjacent positions, the cam followers 99 are lowered, so that the grippers 94 are returned into a closed state by the biasing force of the springs (see FIG. 11C).

Thus, the cam followers 99 are moved up and down along the cam plate 101, thereby rotating the grippers 94 on the gripper rotation shaft 98 to open and close the grippers 94.

Figure 12A:
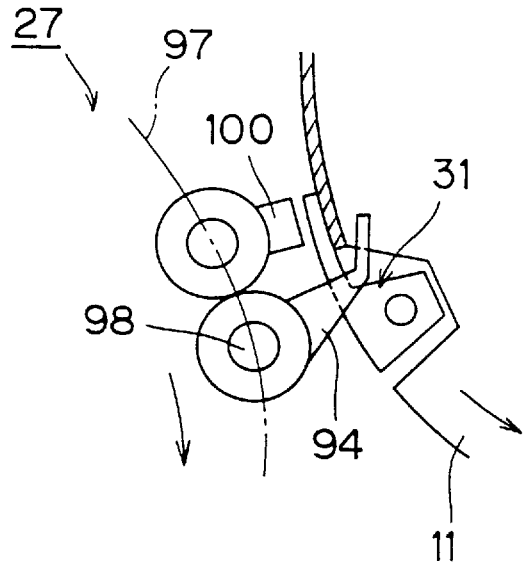
FIGS. 12A, 12B and 12C are diagrams illustrating the operations of the grip claw of the impression cylinder and a gripper of the unloading unit, and a positional relationship therebetween when a printing sheet held by the grip claw is transferred to the gripper.
Figure 12B:
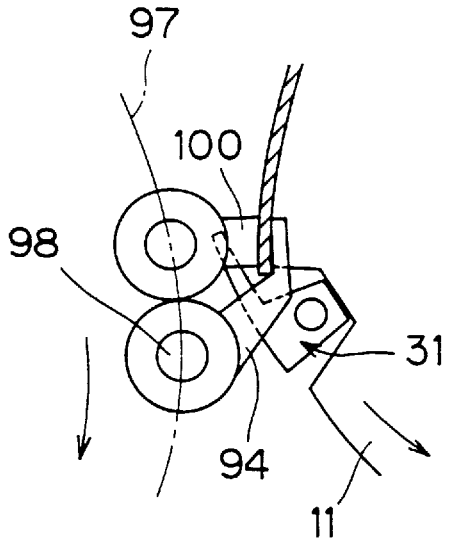
Figure 12C:
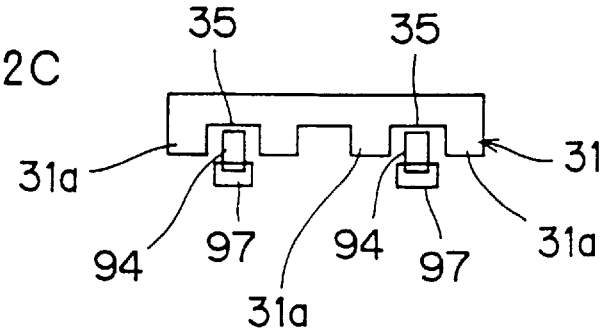

FIGS. 12A to 12C are diagrams for explaining the operations of the grip claw 31 of the impression cylinder 11 and the grippers 94 of the unloading unit 27 and a positional relationship therebetween when the printing sheet P held by the grip claw 31 is transferred to the grippers 94.

As shown in FIG. 12A, when the grip claw 31 of the impression cylinder 11 comes to a position confronting the unloading unit 27, the grip claw 31 and the grippers 94 attached to the chains 97 of the unloading unit 27 are positioned in a timing sequence so that the grippers 94 can confront the impression cylinder 11 or cross the grip claw 31.

The grip claw 31 of the impression cylinder 11 and the grippers 94 of the unloading unit 27 are driven to perform their respective open and close operations in synchronism for the transfer of the leading edge of the sheet P. More specifically, when the grip claw 31 crosses the grippers 94, the grip claw 31 assumes the closed state, and the grippers 94 assume the open state (see FIG. 12A). In turn, the grip claw 31 is opened, and the grippers 94 are closed (see FIG. 12B). As the impression cylinder 11 is further rotated, the sheet P on the impression cylinder 11 is transferred to the unloading unit 27.

FIG. 12C is a schematic diagram of the grip claw 31 and the grippers 94 as viewed from a direction perpendicular to the axis of the impression cylinder 11. As shown in FIG. 12C, the grippers 94 are located in conformity with the cut-away portions 35 of the grip claw 31. Therefore, the grip claw 31 does not bump against the grippers 94 even if they cross each other as viewed from the axial direction of the impression cylinder.

The grippers 94 are moved by means of the chains 97 and, when the sheet P held thereby reaches the sheet discharging section 29 (see FIG. 2), the grippers 94 are opened by the cam followers 99 operated by a cam plate (not shown), whereby the sheet is plural in the sheet discharging section 27.

Figure 13:
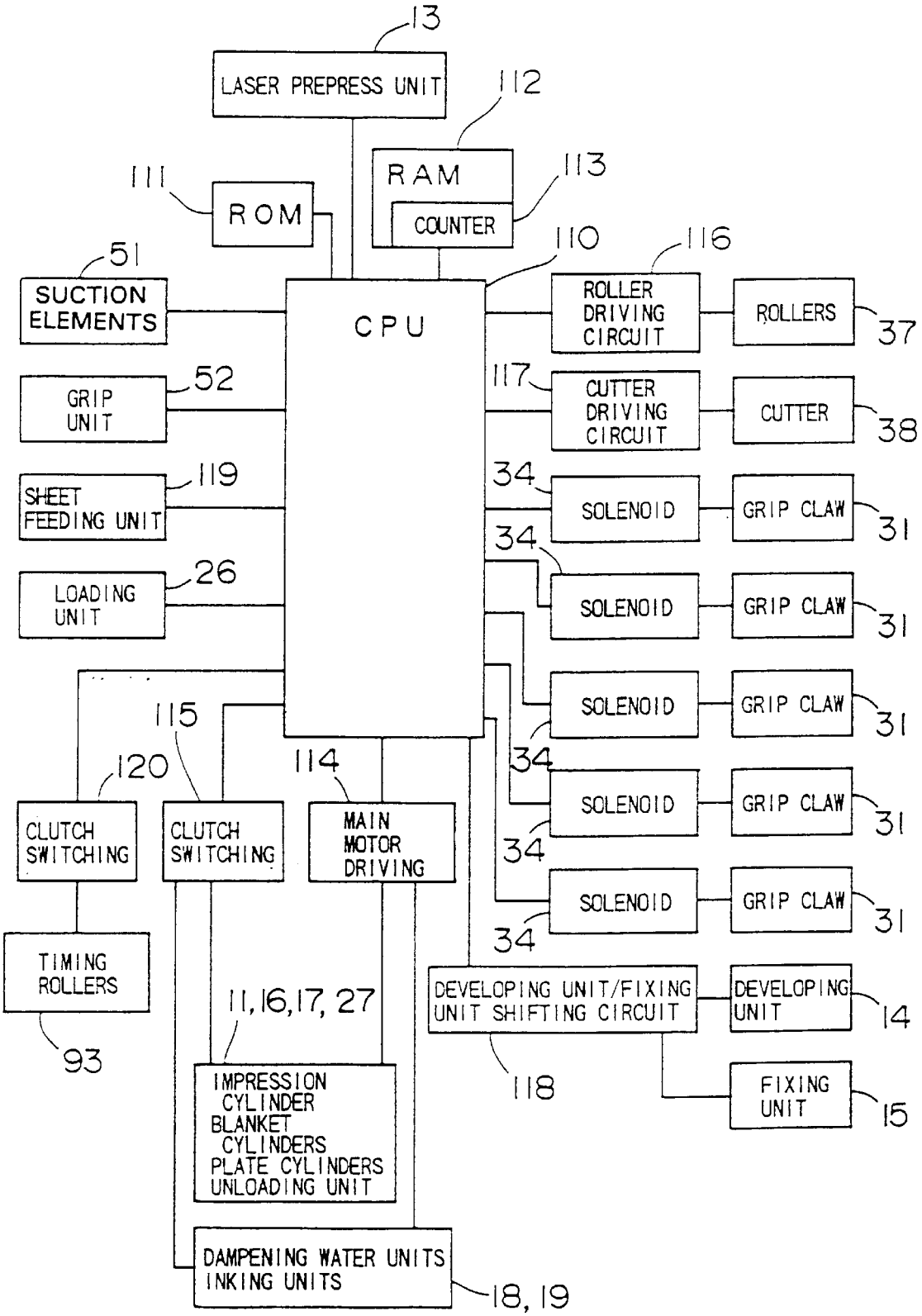
FIG. 13 is a block diagram illustrating an exemplary construction of control circuitry according to the first embodiment of the present invention.

FIG. 13 is a block diagram illustrating an exemplary construction of a control circuit for the digital printer 10 shown in FIG. 2.

The digital printer 10 has a CPU 110 as a control center. The CPU 110 is connected to a ROM 111 storing predetermined operation programs necessary for the control of the digital printer 10, and a RAM 112 for temporarily storing therein data for the control. The RAM 112 includes an area for a counter 113 for counting operations to be performed in a control operation which will be described later.

The CPU 110 controls a main motor driving circuit 114 and a clutch switching circuit 115. The impression cylinder 11, the blanket cylinders 16, the plate cylinders 17 and the unloading unit 27 are operated by the main motor driving circuit 114 and the clutch switching circuit 115. In association with the operation of the plate cylinders 17, the dampening water units 18 and the inking units 19 are also operated by the circuits 114 and 115.

The CPU 110 is further connected to a roller driving circuit 116 for driving the laser prepress unit 13 and the rollers 37 for drawing out the plate blank 36 from the plate blank cassette 12, a cutter driving circuit 117 for driving the cutter 38, and five solenoids 34 for controlling the five grip claws 31 respectively provided in the five peripheral regions of the impression cylinder 11.

The CPU 110 is still further connected to a developing unit/fixing unit shifting circuit 118 for shifting the developing unit 14 and the fixing unit 15 toward and away from the impression cylinder 11.

The CPU 110 is still further connected to the suction elements 51 of the blanket cylinders 16 (more specifically, a vacuum pump driving circuit or the like for operating the suction elements 51) and the grip units 52 of the plate cylinders 17. The CPU 110 is still further connected to a clutch switching circuit 120 for switching a sheet feeding mechanism 119 of the sheet feeding section 25, the loading unit 26 and the timing rollers 93.

Though not shown, the CPU 110 receives signals applied from various sensors such as a sheet transportation sensor provided in the digital printer 10. The CPU 110 uses the signals from these sensors for the control operation.

It should be noted that the control circuitry shown in the block diagram of FIG. 13 is merely one example and the control circuitry may have a different construction. It is preferred that the respective components of the digital printer 10 are controlled by the CPU 110.

Figure 14:
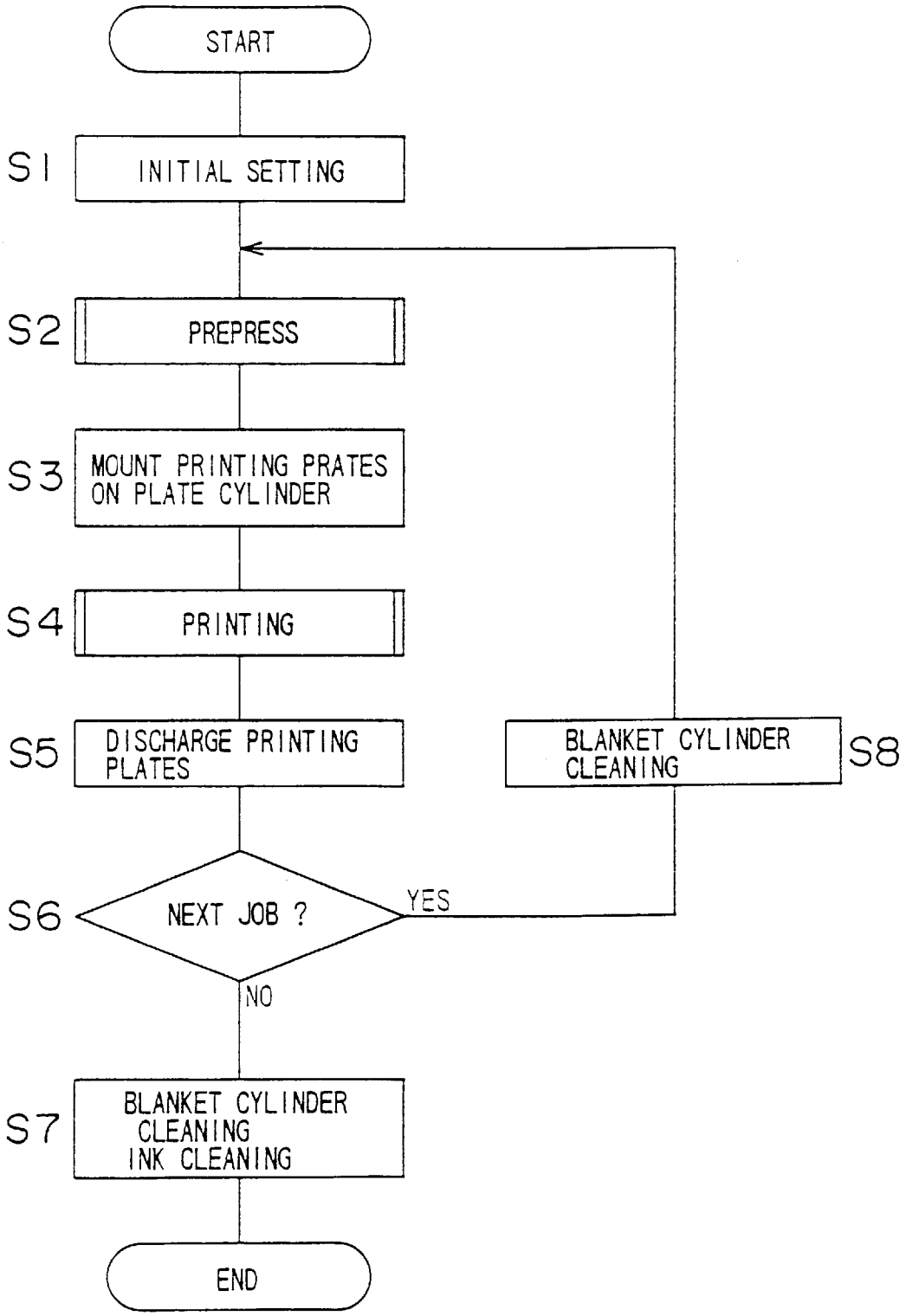
FIG. 14 is a flow chart illustrating a comprehensive control operation according to the first embodiment of the present invention.

FIG. 14 is a flow chart illustrating a comprehensive control operation of the digital printer 10 to be performed by the CPU 110 of FIG. 13. Following the flow shown in FIG. 14, an explanation will be given to the comprehensive operation of the digital printer 10.

Upon starting the control operation, an initial setting operation and the like is performed (Step S1). In the initial setting operation, for example, the impression cylinder 11, the blanket cylinders 16, the plate cylinders 17 and the like are each set at a predetermined initial angular position, and work registers and the like in the RAM 112 are each cleared into an initial state.

After the completion of the initial setting operation, the prepress process is performed (Step S2), which will be detailed later with reference to a detailed flow chart.

After the completion of the prepress process, printing plates held on the impression cylinder 11 are respectively placed on the plate cylinders 17 (Step S3), and the printing process is performed (Step S4).

After the completion of the printing process, the printing plates on the plate cylinders 17 are each transported to the unloading unit 27 via the impression cylinder 11, and discharged to the plate discharging section 28 (see FIG. 2) (Step S5). The transportation of the printing plates is achieved in the same manner as the transportation of the printed sheet.

In turn, it is determined if there is any job to be next performed (Step S6). That is, it is determined if the prepress process and the printing process are to be performed subsequently. If another job is to be performed, the blanket cylinders 16 are cleaned (Step S8). The cleaning of the blanket cylinders 16 is achieved, for example, by applying cleaning liquid onto the peripheries of the blanket cylinders 16 and wiping it away with paper or the like. Where the cleaning operation is to be automatically performed, cleaning units (not shown) respectively provided in association with the peripheries of the blanket cylinders 16 serve for the automatic cleaning operation. Where the cleaning operation is to be manually performed, an indicator may be provided for indicating a need for the cleaning of the blanket cylinders 16. On the basis of the indication, the manual cleaning operation for the blanket cylinders is performed.

If there is no subsequent job to be performed, an ink cleaning operation is performed along with the aforesaid cleaning operation for the blanket cylinders 16 (Step S7). The ink cleaning operation is achieved by applying cleaning liquid onto the inking rollers 24 and wiping it away with blades or the like. The ink cleaning operation may be automatically performed by special cleaning units or, alternatively, may be manually performed on the basis of indication by an indicator for indicating a need for the ink cleaning operation.

Figure 15:
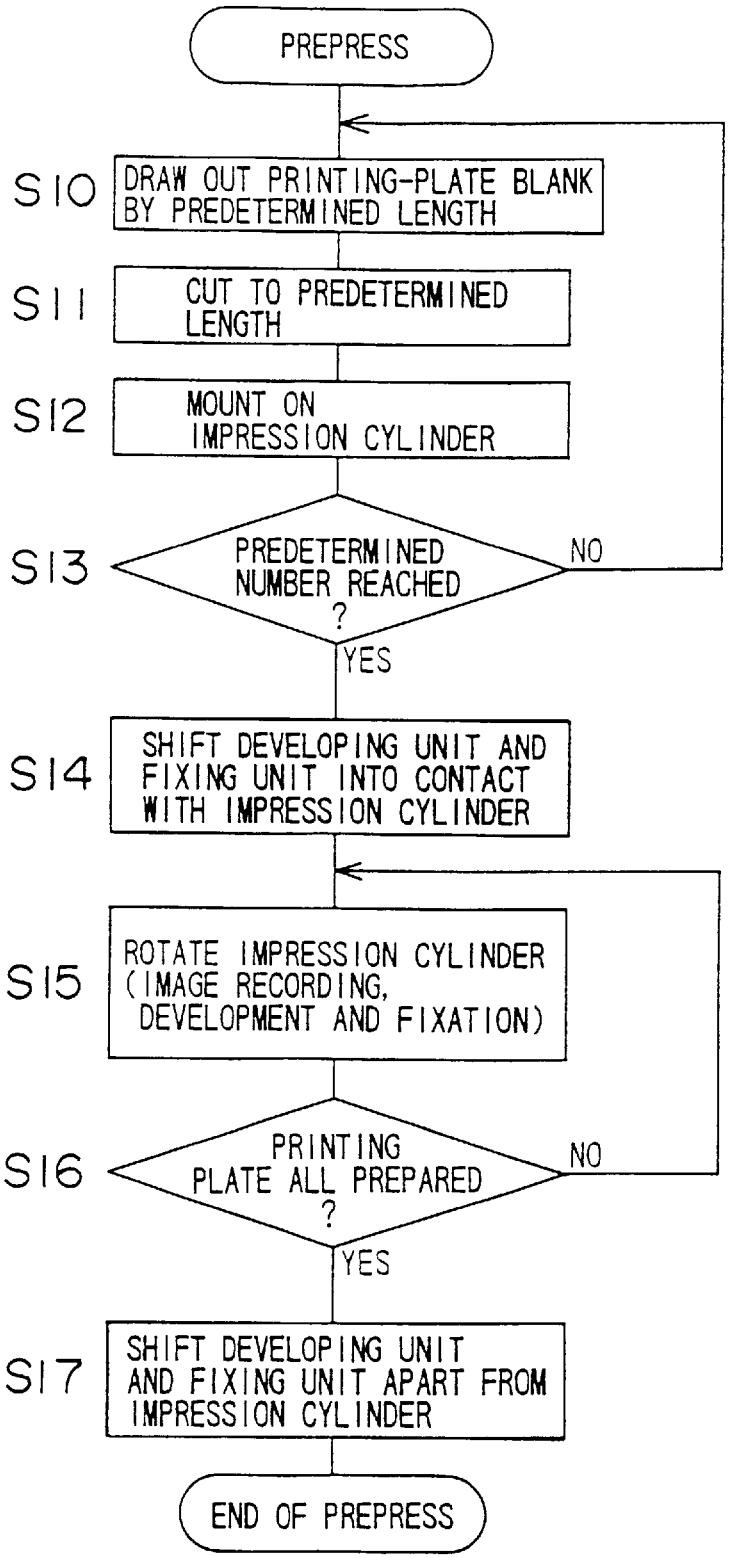
FIG. 15 is a flow chart illustrating a control operation for the prepress process according to the first embodiment.

FIG. 15 is a flow chart illustrating in detail the control operation in the prepress process of Step S2 shown in FIG. 14. In the flow chart shown in FIG. 15, the control operation in the prepress process is directed to a case where a resin sheet formed with a silver salt photosensitive layer is used as the plate blank 36 (see FIG. 4A).

In the prepress process, the rollers 37 are driven by the roller driving circuit 116 to draw out the plate blank 36 by a predetermined length (Step S10). The length of the plate blank to be drawn out can be controlled by a roller driving period during which the rollers 37 are driven. Alternatively, the length of the plate blank 36 may be controlled by detecting the length by way of an output from a pulse plate adapted to rotate in association with the rotation of the rollers 37.

When the plate blank 36 is drawn out by the predetermined length, the cutter driving circuit 117 actuates the cutter 38 to cut the plate blank 36 to provide a printing plate 30 (Step S11).

When the leading edge of the plate blank 36 drawn out from the plate blank cassette 12 reaches one grip claw 31 of the impression cylinder 11, the corresponding solenoid 34 is actuated to allow the grip claw 31 to hold the leading edge of the plate blank 36. In this state, the impression cylinder 11 is rotated in the direction of the arrow 20, whereby one piece of the plate blank is mounted on a peripheral region of the impression cylinder 11 (Step S12).

Upon completion of the mounting of one printing plate, the counter 113 of the RAM 112 is incremented by one. Then, it is determined whether the value of the counter 113 reaches a predetermined value, i.e., "4" (Step S13).

The process sequence from Step S10 to Step S13 is repeated until the value of the counter 113 reaches "4".

When the value of the counter 113 reaches "4", four printing plates 30 are held on the impression cylinder 11.

When the impression cylinder 11 is rotated to a predetermined angular position, a control signal is applied to the developing unit/fixing unit moving circuit 118, and the developing unit 14 and the fixing unit 15 are shifted toward and make contact with the periphery of the impression cylinder 11 (Step S14). As previously described, the rotation of the impression cylinder 11 and the shifting of the developing unit 14 and the fixing unit 15 are controlled so that the developing unit 14 and the fixing unit 15 are positioned to confront a peripheral region of the impression cylinder 11 holding no printing plate 30 when the developing unit 14 and the fixing unit 15 are shifted toward and brought into contact with the periphery of the impression cylinder 11.

In turn, the impression cylinder 11 is rotated, and the laser prepress unit 13 is driven. As a result, images corresponding to black, cyan, magenta and yellow are respectively recorded on the four printing plates 30 held on the periphery of the impression cylinder 11 by exposing the printing plates 30 to light in accordance with the images to be formed thereon by means of the laser prepress unit 13. The printing plates 30 are subjected to development and fixation by means of the developing unit 14 and the fixing unit 15, respectively (Step S15).

Since the printing plates 30 are prepressed one by one, it is determined in Step S16 whether the four printing plates are all subjected to the prepress process. After the completion of the prepress of the four printing plates 30, the developing unit 14 and the fixing unit 15 are shifted away from the periphery of the impression cylinder 11 by the shifting circuit 118 (Step S17).

Thus, the prepress process is completed.

As detailed above, the digital printer 10 according to the first embodiment performs the prepress process with the printing plates 30 wound around the impression cylinder 11. Then, the printing plates 30 prepared on the impression cylinder 11 are respectively transported onto the plate cylinders 17 provided around the impression cylinder 11. Thus, the digital printer adapted to prepare the printing plates on the impression cylinder 11 by employs only one laser prepress unit 13 provided in association with the periphery of the impression cylinder 11 for the prepress of the printing plates.

The impression cylinder 11 has sheet retention devices, i.e., the grip claws 31, which are also used as plate retention devices during the prepress process. Therefore, the digital printer of this embodiment is advantageous in that the construction of the impression cylinder 11 can be simplified by allowing the retention devices to be used for holding both printing plates and printing sheets and in that only one laser prepress unit 13 is employed.

Figure 16:
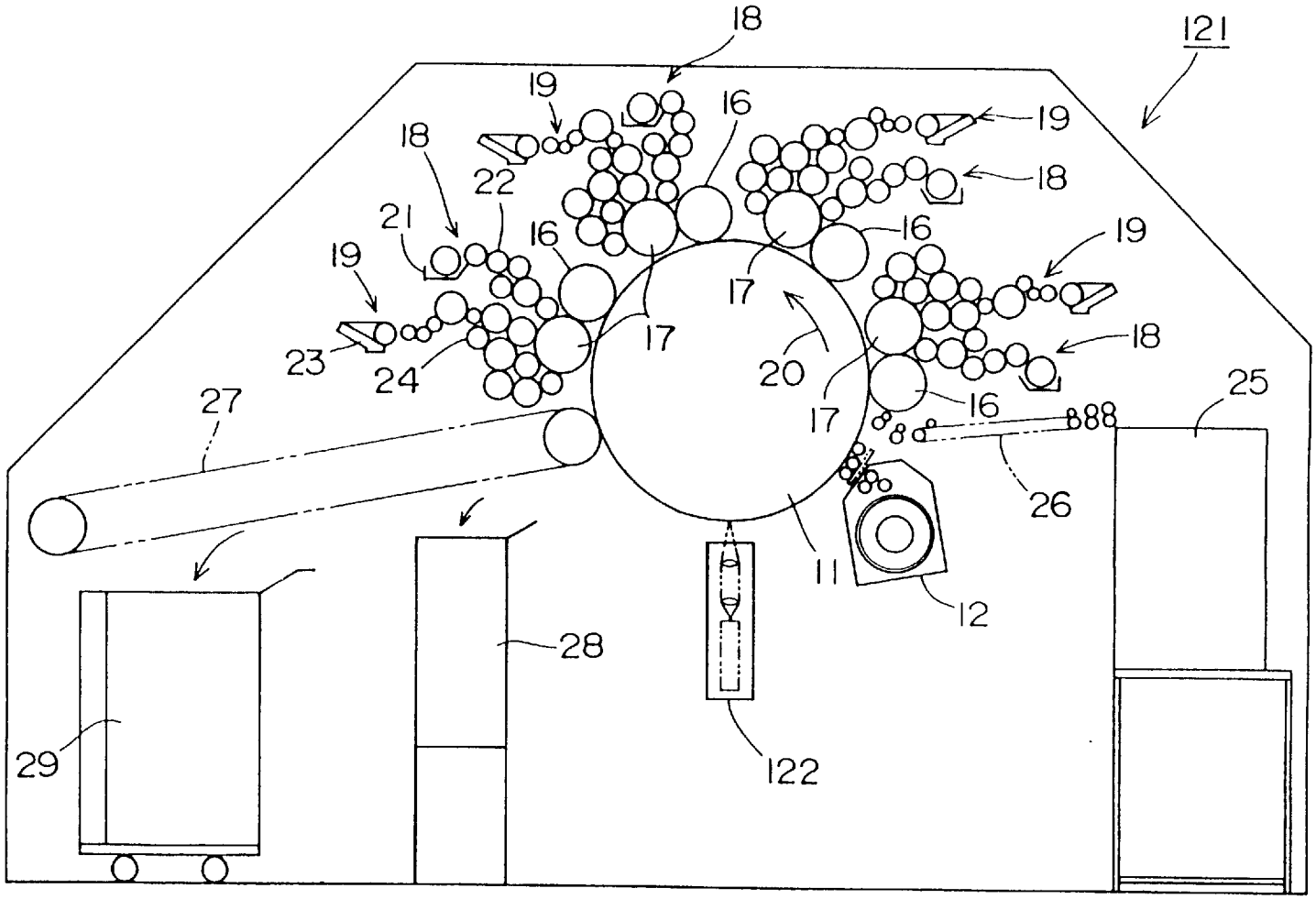
FIG. 16 is a schematic diagram illustrating a digital printer according to a second embodiment of the present invention.

FIG. 16 is a schematic diagram illustrating the construction of a digital printer 121 according to a second embodiment of the present invention. The digital printer 121 of FIG. 16 is characterized in that a so-called high power laser output unit 122 is employed as the laser prepress unit. The high power laser output unit 122 has a plurality of laser optical systems arranged along the axial length of the impression cylinder 11, i.e., in a direction perpendicular to the plane of FIG. 16. The light exposure for the image formation is not achieved by scanning a laser beam by means of the polygon mirror 43 as shown in FIG. 5, but the light exposure along the main scanning direction is effected at one time by laser beams outputted from the plurality of laser optical systems. The use of the high power laser output unit 122 speeds up the light exposure for the prepress, thereby shortening the time required for the prepress process. The second embodiment uses a plate blank which does not require development and fixation as explained in the prior art.

Since the digital printer 121 has substantially the same construction as the digital printer 10 described with reference to FIG. 2 except the aforesaid points, the same or corresponding components thereof are designated by the same reference numerals and a detailed explanation will not be given thereto.

Figure 17:
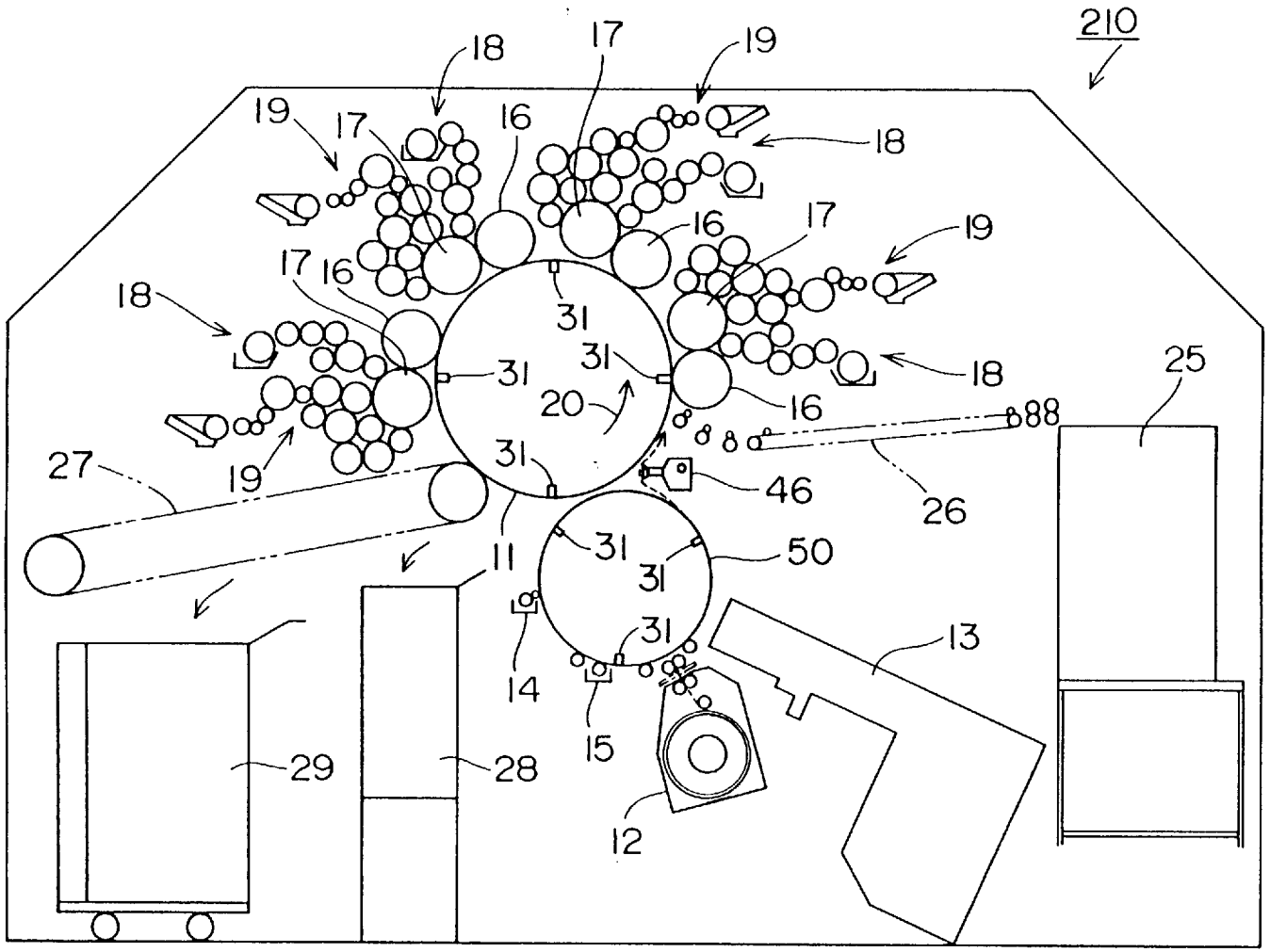
FIG. 17 is a schematic diagram illustrating a digital printer according to a third embodiment of the present invention.

FIG. 17 is a schematic diagram illustrating a digital printer 210 according to a third embodiment of the present invention. The digital printer 210 has an impression cylinder 11. The impression cylinder 11 is of an elongate cylindrical configuration extending perpendicular to the plane of FIG. 17. The periphery of the impression cylinder 11 is circumferentially divided into four peripheral regions, for example, on which printing sheets can be respectively held. Each of the four peripheral regions of the impression cylinder 11 is provided with a grip claw 31 for the printing-sheet retention. The construction of the grip claw 31 is the same as in the first embodiment.

Four printing units each having a blanket cylinder 16, a plate cylinder 17, a dampening water unit 18 and an inking unit 19 are disposed adjacent to the periphery of the impression cylinder 11 on the upper side thereof. The four printing units respectively used for the printing of black, cyan, magenta and yellow images are disposed along the direction of rotation of the impression cylinder 11 (indicated by an arrow 20). These printing units have the same construction as in the first embodiment.

Below the impression cylinder 11 is disposed a prepress cylinder 50 which confronts a lower side portion of the periphery of the impression cylinder 11. The periphery of the impression cylinder 11 is spaced a bit apart from the periphery of the prepress cylinder 50 to prevent the contact therebetween occurring. The prepress cylinder 50 is of an elongate cylindrical configuration extending perpendicular to the plane of FIG. 17. The periphery of the prepress cylinder 50 is circumferentially divided into three peripheral regions, for example, on which printing plates are respectively held. Each of the three peripheral regions of the prepress cylinder 50 is provided with a grip claw 31 for the printing-plate retention. The grip claw 31 has the same construction as in the first embodiment.

Around the prepress cylinder 50 are disposed a plate blank cassette 12, a laser prepress unit 13, a developing unit 14 and a fixing unit 15 each confronting the periphery of the prepress cylinder 50. The constructions and operations of these components will be described later.

A plate transferring device 46 is provided in association with the prepress cylinder 50 and the impression cylinder 11. The plate transferring device 46 is adapted to receive the printing plates prepared on the prepress cylinder 50 and transfer the printing plates to the impression cylinder 11. The printing plates transferred to the impression cylinder 11 are transported to the plate cylinder 17 and mounted thereon as will be described later.

The digital printer 210 further includes a sheet feeding section 25 for accommodating printing sheets, a loading unit 26 for transporting a sheet taken out of the sheet feeding section 25 to the impression cylinder 11, an unloading unit 27 for receiving and transporting a printing plate used for printing or a printed sheet from the impression cylinder 11, a plate discharging section 28 for receiving the printing plate from the unloading unit 27 and a sheet discharging section 29 for receiving the sheet from the unloading unit 27. These components respectively have the same constructions as in the first embodiment described with reference to FIG. 2.

FIGS. 18A to 18D are diagrams for explaining the operations and functions of the prepress cylinder 50, the plate blank cassette 12, the laser prepress unit 13, the developing unit 14 and the fixing unit 15 during a prepress process in accordance with the third embodiment.

A rolled plate blank 36 (printing plate yet to be subjected to image recording) is accommodated in the plate blank cassette 12. In this embodiment, a resin sheet formed with a silver salt photosensitive layer is used as the plate blank 36. The plate blank 36 accommodated in the plate blank cassette 12 is drawn out therefrom by means of a plurality of rollers 37 provided in the plate blank cassette 12, and the leading edge of the plate blank 36 is then held by one grip claw 31 of the prepress cylinder 50 (see FIG. 18A). As the prepress cylinder 50 is rotated in a direction of an arrow 76 in this state, the plate blank 36 is wound around the prepress cylinder 50. When the plate blank 36 is drawn out by a predetermined length, a cutter 38 provided in the plate blank cassette 12 is actuated to cut the plate blank 36. The trailing edge of the printing plate 30 is held by means of a suction mechanism (not shown) provided in the prepress cylinder 50.

Figure 18A:
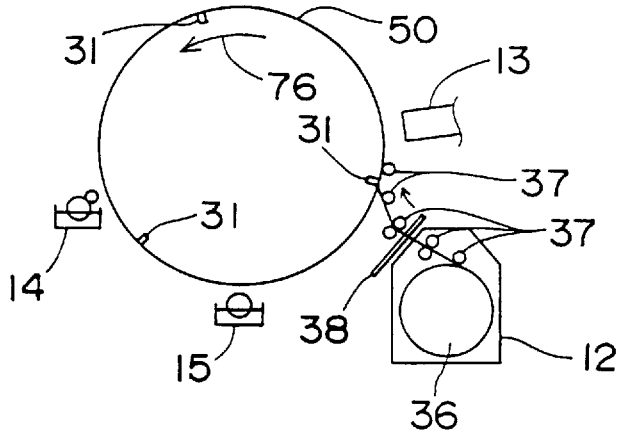
FIGS. 18A, 18B and 18C are diagrams for explaining the operations and functions of a prepress cylinder, a plate blank cassette, a laser prepress unit, a developing unit and a fixing unit in a prepress process in accordance with the third embodiment of the present invention.
Figure 18B:
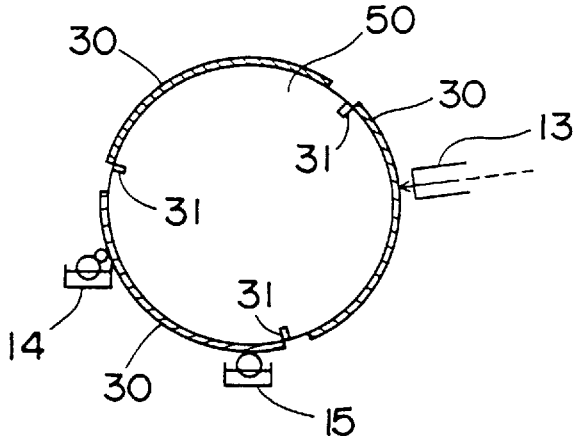

After the plate blank 36 is drawn out and a predetermined number of printing plates 30 (one to three printing plates for the printer shown in FIGS. 18A to 18D) are mounted on the periphery of the prepress cylinder 50, images are recorded on the printing plates 30 by means of the laser prepress unit 13 (see FIG. 18B). The images recorded on the printing plates 30 are developed by the developing unit 14 and fixed on the printing plates by the fixing unit 15 (see FIG. 18B).

As described above, the image recording by the laser prepress unit 13 is performed after the predetermined number of printing plates 30 are mounted on the periphery of the prepress cylinder 50. Alternatively, the image recording by the laser prepress unit 13 may be performed in association with the operation of mounting the plate blank on the periphery of the prepress cylinder 50, i.e., the image recording may be performed on a plate blank 36 currently being subjected to the mounting operation or on a printing plate 30 immediately after the mounting operation.

Figure 18C:
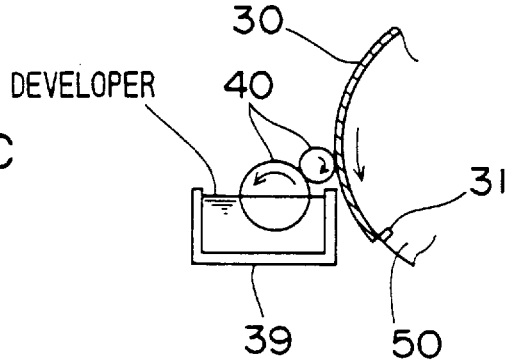
Figure 18D:
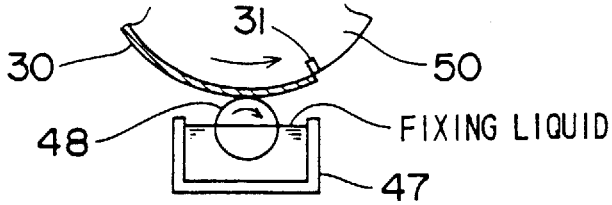

In the developing unit 14, developing liquid in a container 39 is to removed by rollers 40 and applied onto the printing plate 30 as shown in FIG. 18C. Similarly, in the fixing unit 15, fixing liquid in a container 47 is remove and then applied onto the printing plate 30 by means of a roller 48 as shown in FIG. 18D. Thus, the image fixation is achieved. The developing unit 14 and the fixing unit 15 are each adapted to shift between a contact position and a non-contact position with respect to the periphery of the prepress cylinder 50. For the development and fixation, the development unit 14 and the fixing unit 15 are brought into contact with the periphery of the prepress cylinder 50 just before a printing plate 30 to be subjected to the developing/fixing operation reaches the developing unit 14 and the fixing unit 15. After the completion of the development and fixation, the developing unit 14 and the fixing unit 15 are shifted away from the periphery of the prepress cylinder 50 to the non-contact position.

In this embodiment, the periphery of the prepress cylinder 50 is divided into the three peripheral regions as described above, on which printing plates 30 are respectively held. Therefore, three printing plates 30 can be sequentially prepared in this embodiment.

The printing plates 30 subjected to the image recording, the development and the fixation on the prepress cylinder 50 are transferred from the prepress cylinder 50 to the impression cylinder 11 as will be described later. After the transfer of the printing plates 30 to the impression cylinder 11, the peripheral regions of the prepress cylinder 50 are empty, which may be used for a subsequent cycle of the prepress process.

It should be noted that color image printing requires four printing plates 30 for four print colors, i.e., black, cyan, magenta and yellow.

Figure 19A:
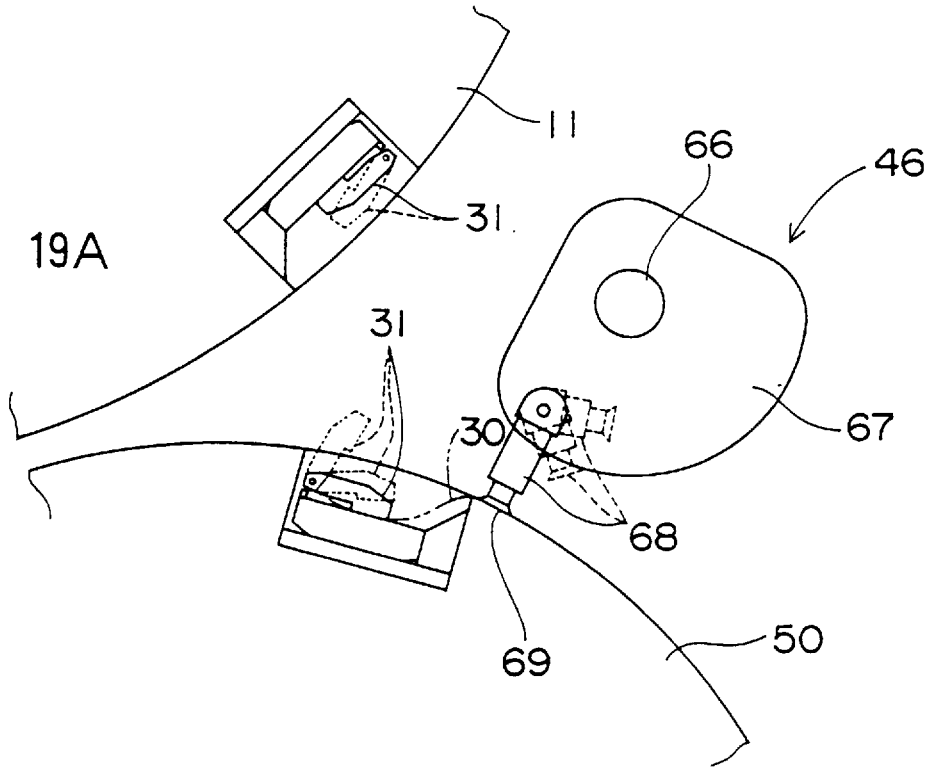
FIGS. 19A and 19B are diagrams for explaining a process for transferring a printing plate from the prepress cylinder to an impression cylinder in accordance with the third embodiment of the present invention.
Figure 19B:
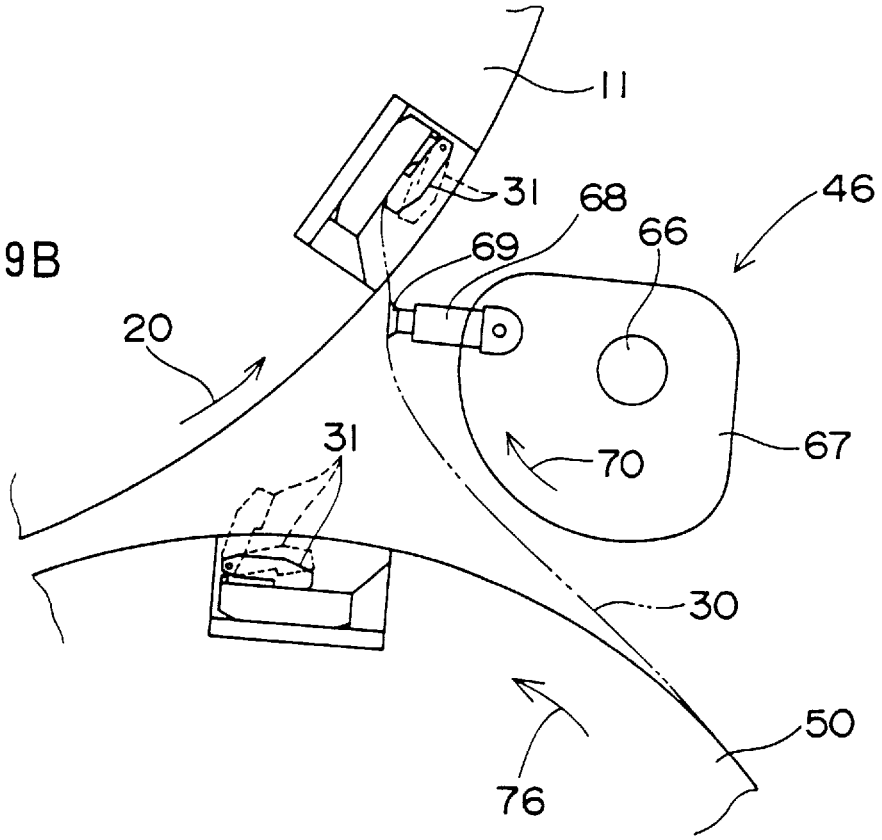

FIGS. 19A and 19B are diagrams for explaining a process for transferring the printing plates 30 from the prepress cylinder 50 to the impression cylinder 11. As shown in FIGS. 19A and 19B, the transfer of the printing plates 30 from the prepress cylinder 50 to the impression cylinder 11 is achieved by the plate transferring device 46.

The plate transferring device 46 is disposed adjacent to a position where the impression cylinder 11 confronts the prepress cylinder 50. The plate transferring device 46 has a frame 67 rotatable on a support shaft 66. A suction pipe 68 is attached to the frame 67, and adapted to rotate with respect to the frame 67 as shown in FIG. 19A. The suction pipe 68 is expandable so that the length thereof is variable. Therefore, the suction pipe 68 is adapted to assume either a state where it does not project from the frame 67 or a state where it projects from the frame 67 with a suction port 69 at the tip thereof contacting the periphery of the prepress cylinder 50 or the impression cylinder 11. Though not shown, the suction pipe 68 is connected to a vacuum pump or the like via a pipe line. Therefore, the suction pipe 68 draws air into the suction port 69 at the tip thereof, so that the printing plate 30 is held by means of the suction port 69 (see FIG. 19B).

When the leading edge of the printing plate 30 (subjected to the image recording, development and fixation) held on the periphery of the prepress cylinder 50 is located as shown in FIG. 19A, for example, the rotation of the prepress cylinder 50 is momentarily stopped. Where the impression cylinder 11 and the prepress cylinder 50 rotate in synchronism, the rotation of the impression cylinder 11 is stopped in response to the stopping of the rotation of the prepress cylinder 50. In this state, the plate transferring device 46 is actuated to rotate and extend the suction pipe 68 as shown in FIG. 19A, and the printing plate 30 on the prepress cylinder 50 is engaged by the suction port 69. Almost simultaneously, the grip claw 31 holding the leading edge of the printing plate 30 is changed to the opened state from the closed state.

In turn, the frame 67 of the plate transferring device 46 is rotated on the support shaft 66 clockwise as indicated by an arrow 70 in FIG. 19B. At the same time, the prepress cylinder 50 and the impression cylinder 11 are rotated in directions indicated by arrows 76 and 20, respectively. The rotation of the prepress cylinder 50 helps the plate transferring device 46 rotating in the direction of the arrow 70 to transport the printing plate 30.

The rotation of the plate transferring device 46 in the direction of the arrow 70 causes the leading edge of the printing plate 30 held by the suction port 69 of the suction pipe 68 to be inserted into the lower side of the grip claw 31 of the impression cylinder 11. In this state, the rotation of the impression cylinder 11 and the prepress cylinder 50 may be momentarily stopped if necessary. (From a mechanical point of view, the stopping of the rotation of these cylinders is not necessarily required.) Then, the grip claw 31 of the impression cylinder 11 is closed, thereby holding the leading edge of the printing plate 30. After the leading edge of the printing plate 30 is held by the grip claw 31 of the impression cylinder 11, the suction by the suction pipe 68 is stopped and the suction pipe 68 is retracted into the frame 67.

Thereafter, the impression cylinder 11 holding the leading edge of the printing plate 30 is rotated in the direction of the arrow 20. In association therewith, the prepress cylinder 50 is rotated in the direction of the arrow 76. Thus, the printing plate 30 is transferred from the prepress cylinder 50 to the impression cylinder 11.

The printing plate 30 transferred from the prepress cylinder 50 to the impression cylinder 11 is further transferred to the plate cylinder 17. The transfer is achieved in the same manner as in the first embodiment.

Figure 20:
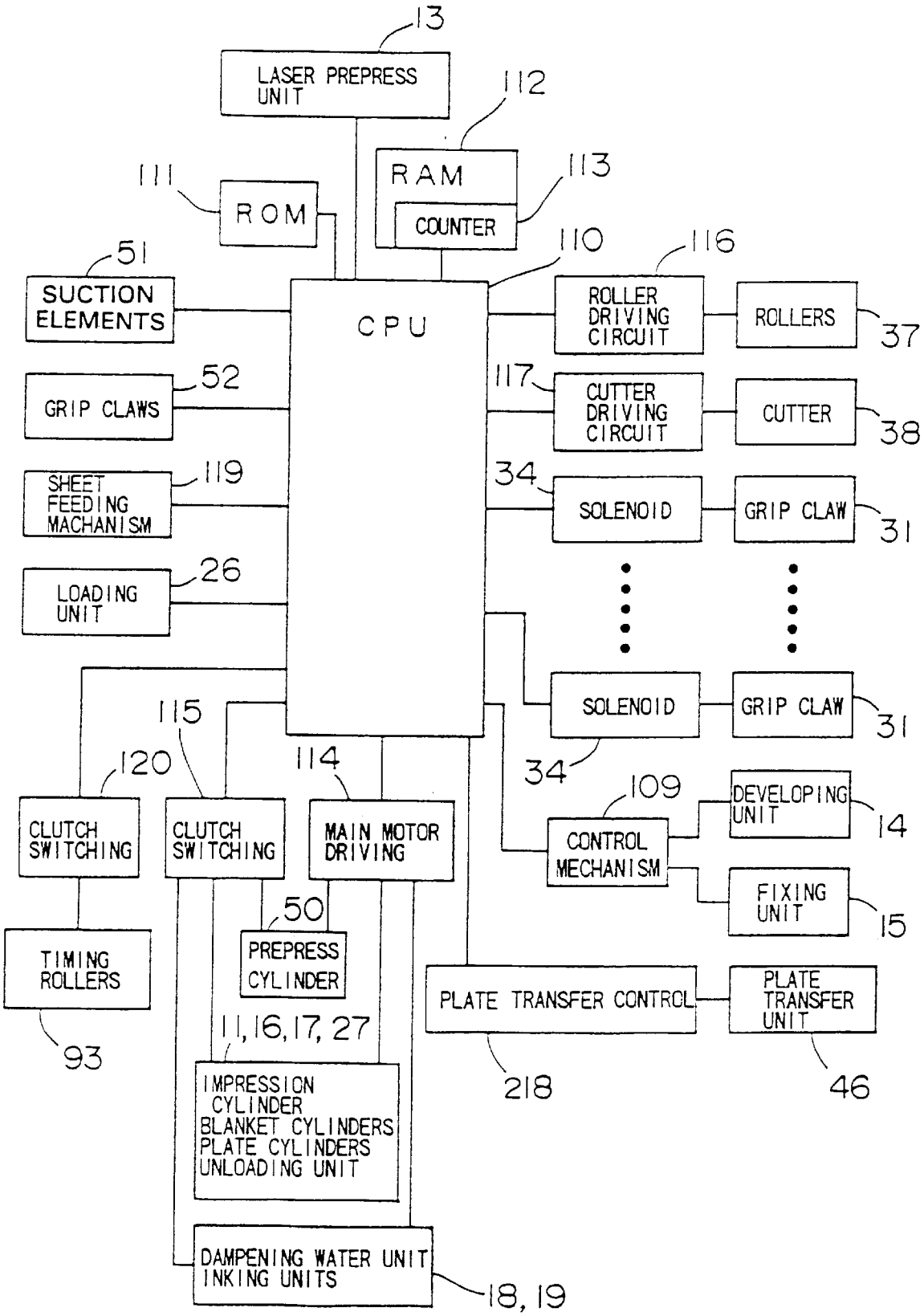
FIG. 20 is a block diagram illustrating an exemplary construction of a control circuitry according to the third embodiment of the present invention.

FIG. 20 is a block diagram illustrating an exemplary construction of a control circuitry of the digital printer 210 shown in FIG. 17.

The block diagram of FIG. 20 is different from that of FIG. 13 as to the following points.

The prepress cylinder 50 is operated by the main motor driving circuit 114 and the clutch switching circuit 115.

The CPU 110 is connected to a plate transfer controlling circuit 218 for controlling the plate transferring device 46. The CPU 110 is further connected to a control mechanism 109 for shifting the developing unit 14 and the fixing unit 15 between the contact position and the non-contact position with respect to the prepress cylinder 50.

It should be noted that the block diagram of the control circuitry shown in FIG. 20 is merely one example, and the control circuitry may have a different construction. It is preferred that the respective components of the digital printer 210 are controlled by the CPU 110.

The comprehensive control operation of the digital printer 210 to be performed by the CPU 110 is the same as in the first embodiment.

Figure 21:
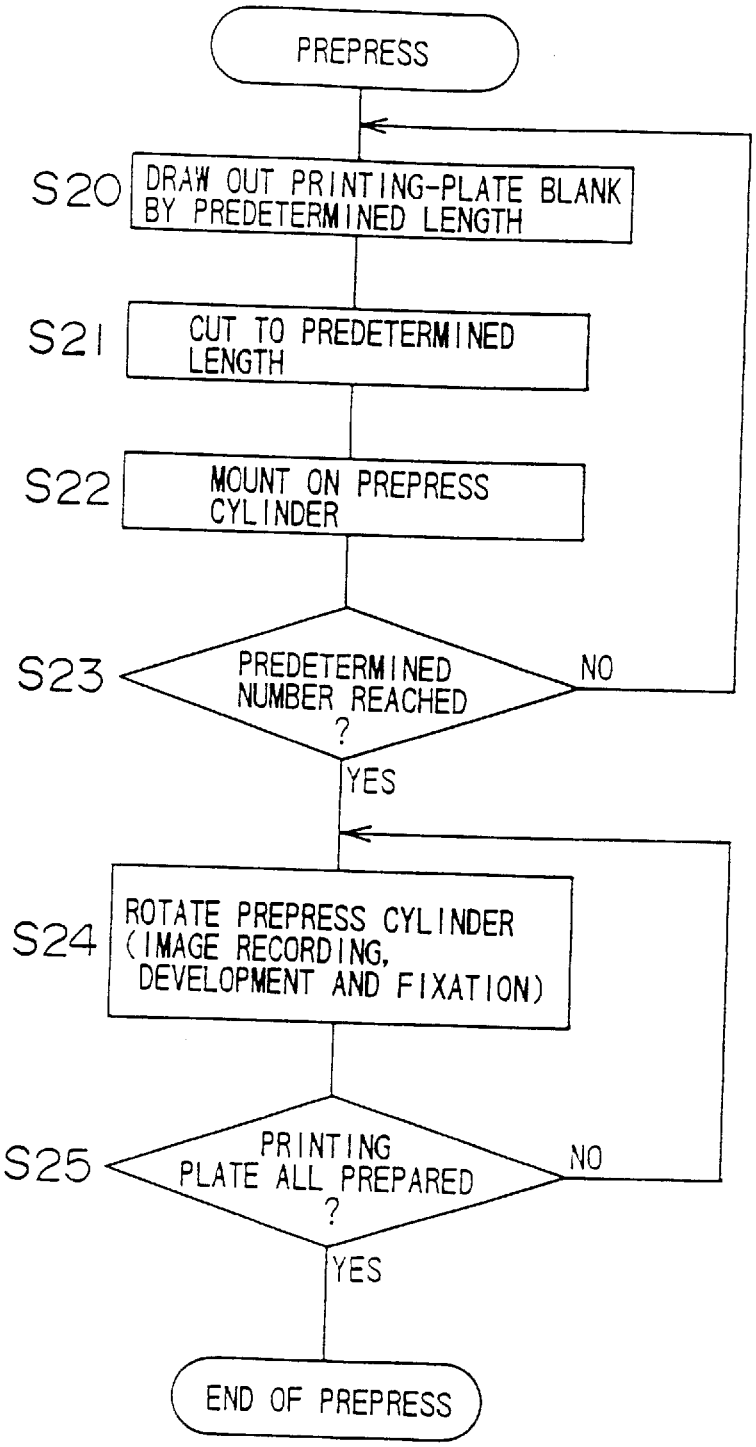
FIG. 21 is a flow chart illustrating a control operation for the prepress process according to the third embodiment of the present invention.

FIG. 21 is a flow chart illustrating in detail a control operation for the prepress process in the digital printer 210. The control operation shown in the flow chart of FIG. 21 is directed to a case where a resin sheet formed with a silver salt photosensitive layer is used as the plate blank 36.

In the prepress process, the rollers 37 are driven by the roller driving circuit 116 (see FIG. 18A) to draw out the plate blank 36 by a predetermined length (Step S20). The length of the plate blank to be drawn out can be controlled by a roller driving period during which the rollers 37 are driven. Alternatively, the length of the plate blank 36 may be controlled by detecting an output from a pulse plate adapted to rotate in association with the rotation of the rollers 37.

When the plate blank 36 is drawn out to the predetermined length, the cutter driving circuit 117 actuates the cutter 38 to cut the plate blank 36 to provide a printing plate 30 (Step S21).

When the leading edge of the plate blank 36 drawn out from the plate blank cassette 12 reaches one grip claw 31 of the prepress cylinder 50, the corresponding solenoid 34 is actuated to allow the grip claw 31 to hold the leading edge portion of the plate blank 36. In this state, the prepress cylinder 50 is rotated in the direction of the arrow 76 in FIG. 18A, whereby one piece of the plate blank is mounted on a peripheral region of the prepress cylinder 50 (Step S22).

Upon completion of the mounting of one printing plate, the counter 113 of the RAM 112 is incremented by one. Then, it is determined whether the value of the counter 113 reaches a predetermined value, i.e., "3" (Step S23).

The process sequence from Step S20 to Step S23 is repeated until the value of the counter 113 reaches "3".

When the value of the counter 113 reaches "3", three printing plates 30 are held on the prepress cylinder 50.

In turn, the prepress cylinder 50 is rotated, and the laser prepress unit 13 is driven. As a result, images for cyan, magenta and yellow are respectively recorded on the three printing plates 30 held on the periphery of the prepress cylinder 50 by exposing the printing plates 30 to light in accordance with the images to be formed thereon by means of the laser prepress unit 13. Just before one image-recorded printing plate 30 comes to a position confronting the developing unit 14, the developing unit 14 is brought into contact with the periphery of the prepress cylinder 50. Similarly, the fixing unit 15 is brought into contact with the periphery of the prepress cylinder 50 just before the developed printing plate 30 comes to a position confronting the fixing unit 15. Thus subjected to development and fixation by means of the developing unit 14 and the fixing unit 15, the printing plates 30 are completed (Step S24).

Since the printing plates 30 are prepressed one by one, it is determined in Step S25 whether the three printing plates are all subjected to the prepress process.

After the three printing plates 30 held on the prepress cylinder 50 are all subjected to the image recording, development and fixation, the prepress process is completed. However, if it is necessary to prepress one more printing plate 30 to be formed with an image for black in addition to the aforesaid three printing plates 30, the prepress process shown in FIG. 21 is performed again after the printing plates 30 on the prepress cylinder 50 are transported to the plate cylinders 17 via the impression cylinder 11.

For the prepress of four printing plates for the four print colors, two cycles of the prepress process may be performed in each of which two printing plates are prepressed. Since the prepress cylinder 50 can hold only three printing plates at the maximum in accordance with this embodiment, the prepress of four printing plates requires two cycles of the prepress process. Alternatively, the prepress of the four printing plates may be achieved at one time by employing a prepress cylinder having a greater diameter.

In the prepress process described above, after the plate blank 36 is drawn out from the plate blank cassette 12 and three printing plates 30 are mounted on the prepress cylinder 50, the three printing plates 30 are subjected to the image recording, development and fixation respectively performed by the laser prepress unit 13, the developing unit 14 and the fixing unit 15. Alternatively, the image recording may be started when the leading edge of the plate blank 36 drawn out from the plate blank cassette 12 is held by the grip claw 31 and reaches the position confronting the laser prepress unit 13. That is, the process control may be performed in such a manner that the image recording by the laser prepress unit 13 is started while the trailing edge of the printing plate 30 is still being drawn out from the plate blank cassette 12.

In consideration of the location of the laser prepress unit 13, after a first printing plate 30 drawn out from the plate blank cassette 12 is mounted on the prepress cylinder 50, the image recording on the first printing plate 30 by the laser prepress unit 13 may be performed while a second printing plate 30 is being drawn out from the plate blank cassette.

With the aforesaid modified arrangement, the drawn-out printing plate can be immediately subjected to the image recording, the development and the fixation while the plate blank 36 is continuously drawn out from the plate blank cassette 12.

The digital printer 210 according to the third embodiment performs the prepress process with the printing plates 30 held on the prepress cylinder 50. Then, the printing plates 30 prepressed on the prepress cylinder 50 are respectively transported via the impression cylinder 11 onto the plate cylinders 17 provided around the impression cylinder 11. Thus, the digital printer adapted to prepress the printing plates on the prepress cylinder 50 employs only one laser prepress unit 13 provided in association with the periphery of the prepress cylinder 50. Further, only one plate blank cassette 12 is required which is provided in association with the periphery of the prepress cylinder 50. Therefore, the construction of the digital printer is simplified.

Concurrently with the printing process performed by operating the impression cylinder 11 and the printing units, i.e., the blanket cylinders 16, the plate cylinders 17, the dampening water units 18, the ink units 19, the sheet feeding mechanism and the like, the prepress process is performed in which a printing plate 30 to be used for a next cycle of the printing process is prepared by operating the prepress cylinder 50, the plate blank cassette 12, the laser prepress unit 13, the developing unit 14 and the fixing unit 15. That is, the printing process and the prepress process can be performed simultaneously, thereby shortening the process time from the prepress to the printing.

Figure 22:
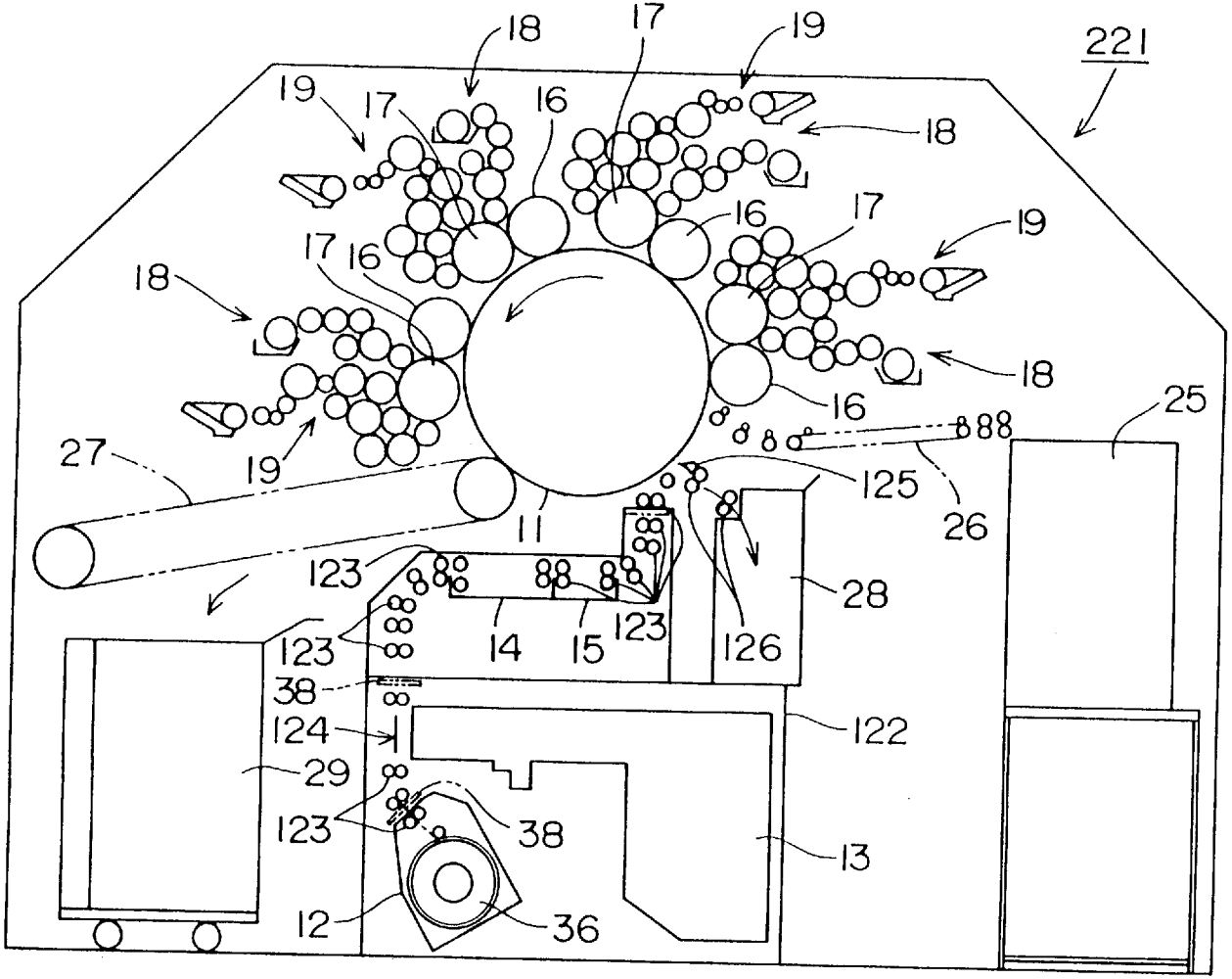
FIG. 22 is a schematic diagram illustrating a digital printer according to a fourth embodiment of the present invention.

FIG. 22 is a schematic diagram illustrating the construction of a digital printer 221 according to a fourth embodiment of the present invention. The digital printer 221 of FIG. 22 is different from the digital printer 210 of FIG. 17 in that the prepress cylinder 50 is not employed for a prepress mechanism.

More specifically, the digital printer 221 has a prepress unit 122 provided below the impression cylinder 11. A plate blank cassette 12 is provided within the prepress unit 122. A rolled plate blank 36 (printing plate yet to be subjected to image recording) is accommodated in the plate blank cassette 12. A multiplicity of transportation rollers 123 are provided along a predetermined transportation path extending from the inside of the plate blank cassette 12 to the outlet thereof. The plate blank 36 is drawn out from the plate blank cassette 12 and transported along the predetermined transportation path by means of the multiplicity of transportation rollers 123. The transportation path defined by the multiplicity of transportation rollers 123 has a predetermined length in the prepress unit 122, and the terminal of the transportation path is connected to the impression cylinder 11.

A laser prepress unit 13 is disposed in the prepress unit 122. The laser prepress unit 13 is adapted to emit light onto the plate blank 36 as it passes a predetermined transportation point 124. That is, the prepress unit 122 is arranged such that an image can be recorded on the printing plate blank by the laser prepress unit 13 while the plate blank is being transported by the transportation rollers 123.

A developing unit 14 and a fixing unit 15 are disposed in predetermined positions along the transportation path within the prepress unit 122. Therefore, the plate blank is transported to the developing unit 14 and the fixing unit 15 by the transportation rollers 123 so as to be subjected to development and fixation during the transportation thereof.

A cutter 38 for cutting the drawn-out plate blank 36 to a predetermined length is provided at a predetermined position of the transportation path adjacent to the outlet of the plate blank cassette 12.

With the aforesaid arrangement of the prepress unit 122, the prepress process can be performed without the use of the prepress cylinder 50. Image-recorded printing plates are transported to the impression cylinder 11 by the transportation rollers 123, and then mounted on the respective plate cylinders 17 via the impression cylinder 11.

Since the laser prepress unit 13, the developing unit 14, the fixing unit 15 are incorporated within the prepress unit 122, a light-shielding arrangement is provided only to the prepress unit 122. Therefore, the digital printer 221 need not have an overall light-shielding construction. More specifically, where a prepress mechanism employs the laser prepress unit 13 for the prepress process, the prepress mechanism is required to have a light-shielding construction for prevention of light incidence thereto. The prepress unit 122 can relatively readily be provided with the light-shielding construction.

Further, by allowing the prepress unit 122 to be constructed as a housing unit having an excellent gas/chemical resistance, the impression cylinder and the printing units are prevented from being affected by gases possibly generated in the prepress process and chemicals used in the developing unit 14 and the fixing unit 15.

Still further, by providing a longer transportation path defined by the transportation rollers 123, a greater number of printing plates can be held on the transportation path, so that printing plates can be subjected to the prepress process during the printing process. That is, the prepress process can be performed simultaneously with the printing process. Printing plates to be used for the next cycle of the printing process can be prepared during the current cycle of the printing process.

In the digital printer 221 shown in FIG. 22, the printing plates which have been used for the printing process are transferred from the plate cylinders 17 to the impression cylinder 11 via the blanket cylinders 16, then transported from the impression cylinder 11 through plate pick-up 125 and rollers 126, and discharged to the plate discharging section 28.

Since the digital printer 221 has substantially the same construction as the digital printer 210 described with reference to FIG. 17 except the aforesaid points, the same or corresponding components thereof are designated by the same reference numerals, and a detailed explanation will not be given thereto.

Figure 23:
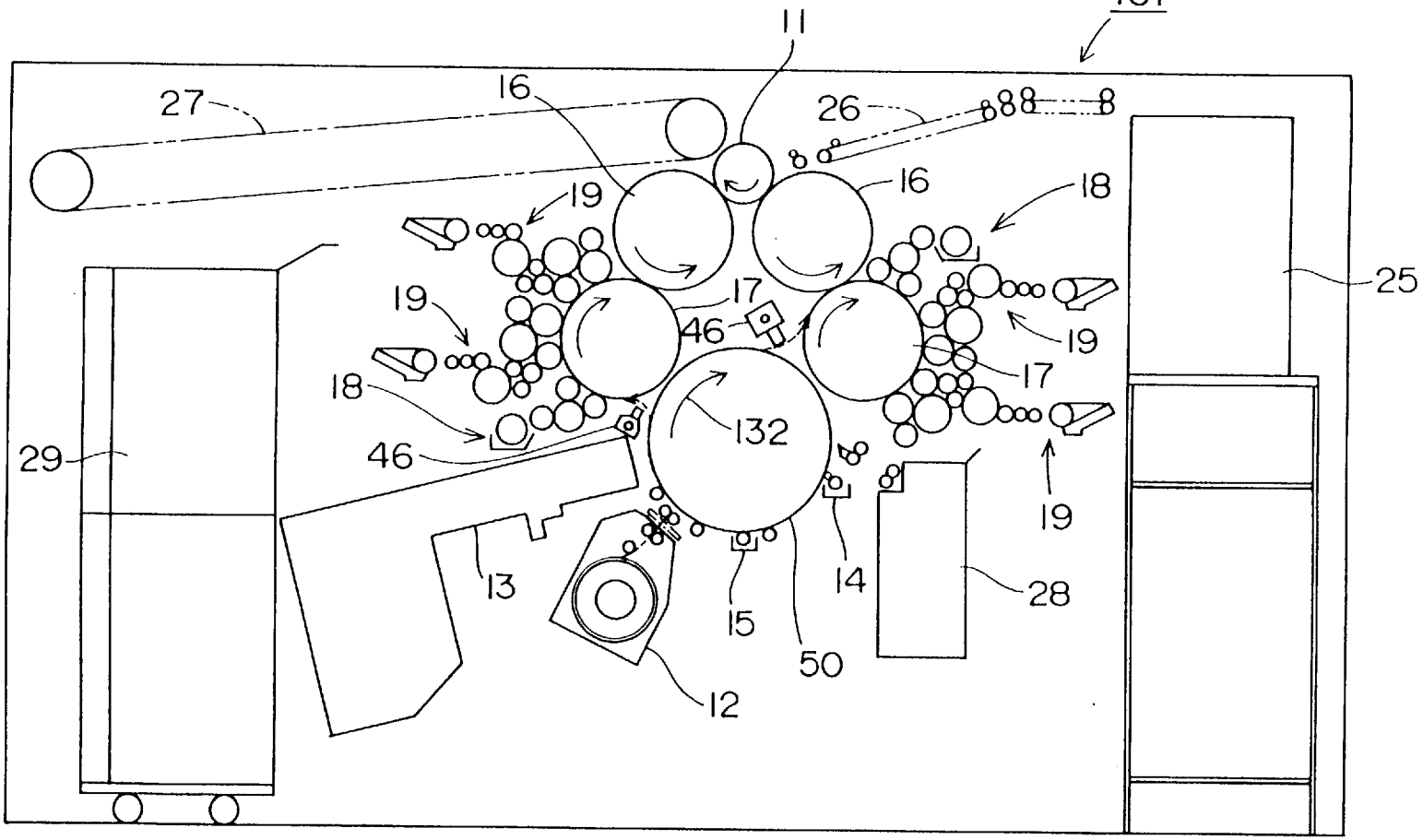
FIG. 23 is a schematic diagram illustrating a digital printer according to a fifth embodiment of the present invention.

FIG. 23 is a schematic diagram illustrating the construction of a digital printer 131 according to a fifth embodiment of the present invention. The digital printer 131 shown in FIG. 23 is characterized as follows.

a. The digital printer 131 has a prepress cylinder 50, around which a single plate blank cassette 12, a single laser prepress unit 13, a developing unit 14 and a fixing unit 15 are disposed. The digital printer 131 is capable of performing a prepress process by using these components concurrently with a printing process.

b. The digital printer 131 includes two plate cylinders 17 each having a diameter twice the diameter of the plate cylinder 17 of the digital printer 210 shown in FIG. 17.

c. The digital printer 131 has a plate transferring device 46 which allows printing plates to be directly transported from the prepress cylinder 50 to the respective plate cylinders 17. That is, the printing plates can be transferred from the prepress cylinder 50 to the plate cylinders 17 without the intervention of an impression cylinder 11.

d. The impression cylinder 11 of the digital printer 131 has a smaller diameter, and four-color printing is performed by way of two rotations of the impression cylinder 11, so that the printing speed is reduced than that of the digital printer 210 shown in FIG. 17.

More specifically, in the prepress process, a plate blank is drawn out from the plate blank cassette 12, and mounted on the prepress cylinder 50. Images are recorded on printing plates thus mounted on the prepress cylinder 50 by means of the laser prepress unit 13, then developed by the developing unit 14, and fixed by the fixing unit 15. The prepress process is performed in substantially the same manner as in the digital printer 10 described with reference to FIG. 17, except that the prepress cylinder 50 is rotated clockwise as indicated by an arrow 132.

The image-recorded printing plates held on the prepress cylinder 50 are transferred to the respective plate cylinders 17 by means of the plate transferring device 46. The construction of the plate transferring device 46 is the same as that of the digital printer 221 described with reference to FIGS. 19A and 19B. More specifically, the printing plates are transferred from the prepress cylinder 50 to the plate cylinders 17 by engaging the leading edge thereof using the suction capability of the plate transferring device 46. The printing plates are wound around the plate cylinders 17 with its leading edge being held thereby. In this digital printer 131, the plate cylinders 17 are each adapted to hold two printing plates or a single printing plate extending over two printing regions on their peripherals. The printing plates held on the plate cylinders 17 are respectively supplied with dampening water by dampening water units 18 and with each color ink by inking units 19. The dampening water units 18 are provided in one-to-one correspondence with the plate cylinders 17. Each of the plate cylinders 17 is provided with two inking units 19 for supplying two color inks thereto.

For example, printing plates for cyan and yellow images are held on the plate cylinder 17 on the right side, whereas printing plates for black and magenta images on the plate cylinder 17 on the left side.

The inks applied on the respective printing plates held on the plate cylinders 17 are transferred onto the blanket cylinders 16. The inks are respectively transferred from the blanket cylinders 16 onto a printing sheet transported from a loading unit 26 to the impression cylinder 11. The printed sheet is transported from an unloading unit 27 to a sheet discharging section 29.

In this embodiment, printing papers are held on the impression cylinder 11 while it makes two turns, thereby achieving four-color printing.

Since the digital printer 131 has substantially the same construction as the digital printer 210 described with reference to FIG. 17 except the aforesaid points, the same or corresponding components thereof are designated by the same reference numerals, and a detailed explanation will not be given thereto.

After the completion of the printing process, the printing plates held on the plate cylinders 17 are transferred to the prepress cylinder 50 by means of the plate transferring device 46, and then transported from the prepress cylinder 50 to the plate discharging section 28.

Figure 24:
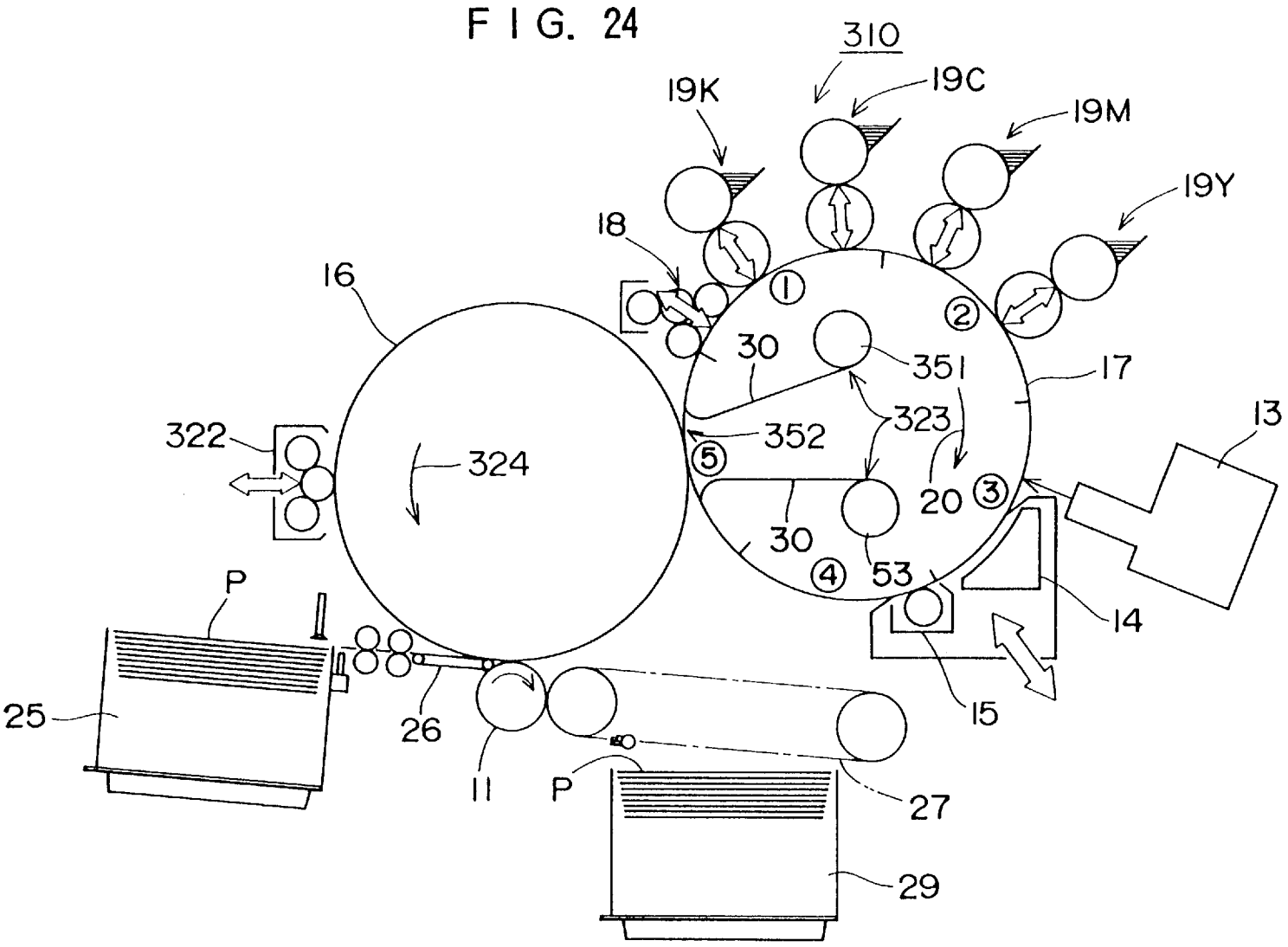
FIG. 24 is a schematic diagram illustrating a digital printer according to a sixth embodiment of the present invention.

FIG. 24 is a schematic diagram illustrating a digital printer 310 according to a sixth embodiment of the present invention. The digital printer 310 has a housing (not shown) defining the exterior thereof, in which components as shown in FIG. 24 are provided.

The digital printer 310 has a plate cylinder 17 and a blanket cylinder 16 provided in contact with the plate cylinder 17. The plate cylinder 17 and the blanket cylinder 16 are of an elongate cylindrical configuration extending perpendicular to the plane of FIG. 24. The plate cylinder 17 has a circumference equivalent to that of the blanket cylinder 16. The periphery of the plate cylinder 17 is circumferentially divided into five peripheral regions (1) to (5), for example, four peripheral regions (1) to (4) of which serve as regions for holding printing plates corresponding to respective print colors. The peripheral region (5) serves as an inlet/outlet for a printing plate 30 supplied from a plate supplying unit 323 provided in the plate cylinder 17.

The plate cylinder 17 is adapted to rotate clockwise as indicated by an arrow 20. A dampening water unit 18, four inking units 19K, 19C, 19M and 19Y (generically designated as "19"), a laser prepress unit 13, a developing unit 14 and a fixing unit 15 are provided around the plate cylinder 17 along the direction of rotation thereof. The dampening water unit 18, the inking units 19, the developing unit 14 and the fixing unit 15 are each adapted to be shifted into contact with and away from the periphery of the plate cylinder 17, as indicated by white arrows, so as to shift between a contact state where they contact the periphery of the plate cylinder 17 and a non-contact state where they are spaced a predetermined distance from the periphery of the plate cylinder 17. The laser prepress unit 13 is spaced a predetermined distance from the periphery of the plate cylinder 17, and adapted to emit a laser beam onto the printing plates 30 held on the periphery of the plate cylinder 17 in accordance with the respective color print images as will be described later. The periphery of the blanket cylinder 16 provides regions on which the colored ink is transferred.

The blanket cylinder 16 is rotated counterclockwise as indicated by an arrow 324. The plate cylinder 17 and the blanket cylinder 16 are rotated in synchronism.

A cleaning unit 322 is provided at a predetermined position on the blanket cylinder 16. The cleaning unit 322 is adapted to be shifted into contact with and away from the periphery of the blanket cylinder 16, as indicated by a white arrow, so as to shift between a contact state where it contacts the periphery of the blanket cylinder 16 and a non-contact state where it is spaced a predetermined distance from the periphery of the blanket cylinder 16.

An impression cylinder 11 is disposed adjacent to the blanket cylinder 16 in contact with the periphery thereof. The impression cylinder 11 is of an elongate cylindrical configuration extending perpendicular to the plane of FIG. 24. In this embodiment, the impression cylinder 11 has a circumference one fifth that of the blanket cylinder 16. The impression cylinder 11 has a grip claw for holding the leading edge of a sheet P. The grip claw has the same construction as that in the foregoing embodiments.

The digital printer 310 further includes a sheet feeding section 25. The sheet feeding section 25 accommodates a multiplicity of printing sheets P. The digital printer 310 still further includes a loading unit 26 for transporting printing sheets P sequentially taken out of the sheet feeding section 25 to the impression cylinder 11, an unloading unit 27 for unloading a printed sheet from the impression cylinder 11, and a sheet discharging section 29 for accommodating the printed sheet unloaded by the unloading unit 27.

There will next be described a prepress process and a printing process to be performed in the digital printer 310 shown in FIG. 24.

In the prepress process, the dampening water unit 18 and the four inking units 19 are positioned apart from the periphery of the plate cylinder 17. The developing unit 14 and the fixing unit 15 are initially positioned apart from the periphery of the plate cylinder 17. The plate cylinder 17 is stopped at a predetermined angular position with the peripheral region (5) thereof brought in contact with the blanket cylinder 16 as shown in FIG. 24.

In this state, a printing plate 30 is supplied from the plate supplying unit 323 provided in the plate cylinder 17. More specifically, the printing plate 30 (yet to be subjected to image recording) which is rolled around a first retention member 351 in the plate supplying unit 323 is drawn out. The drawn-out printing plate 30 is led through a gap 352 provided in the peripheral region (5) of the plate cylinder 17, and wound around the plate cylinder 17 clockwise, and further led into the plate cylinder 17 through the gap 352 for accommodation thereof. The printing plate 30 led into the plate cylinder 17 is wound up by a second retention member 53 of the plate supplying unit 323. The first and second retention members 351 and 53 are rotated by a driving mechanism not shown. Thus, the printing plate 30 (yet to be subjected to the image recording) drawn out from the first retention member 351 is held on at least the four peripheral regions (1) to (4) of the plate cylinder 17.

In turn, the plate cylinder 17 is rotated clockwise as indicated by an arrow 20. When the plate cylinder 17 is rotated to a predetermined angular position, e.g., an angular position where the boundary between the fourth and fifth peripheral regions (4) and (5) confronts the laser prepress unit 13, an image recording operation is started in which an image for one print color is recorded on the printing plate 30 in the fourth peripheral region (4) by means of the laser prepress unit 13. At the same time, the developing unit 14 and the fixing unit 15 are brought in contact with the periphery of the plate cylinder 17. Thus, the image recorded on the printing plate by the laser prepress unit 13 is developed by the developing unit 14 and fixed by the fixing unit 15.

Similarly, when the third peripheral region (3) confronts the laser prepress unit 13, an image for another print color is recorded on the printing plate 30 in the third peripheral region (3) by means of the laser prepress unit 13.

In this way, images for black, cyan, magenta and yellow are respectively recorded on the printing plate 30 held on the first to fourth peripheral regions (1) to (4). Thus, the prepress process is completed.

After the completion of the prepress process, the developing unit 14 and the fixing unit 15 are shifted away from the periphery of the plate cylinder 17.

In the printing process, the dampening water unit 18 is brought into contact with the periphery of the plate cylinder 17. With the plate cylinder 17 being rotated in this state, dampening water is supplied to the printing plate 30 held on the periphery of the plate cylinder, i.e., on the first to fourth peripheral regions (1) to (4) for the respective print colors.

The four inking units 19 are each brought in contact with the periphery of the plate cylinder 17 at a predetermined time and then shifted away from the periphery of the plate cylinder 17. More specifically, the inking unit 19K for supplying a black ink is brought into contact only with the first peripheral region (1), and the inking unit 19C for supplying a cyan ink is brought into contact only with the second peripheral region (2). Similarly, the inking units 19M and 19Y are brought into contact only with the peripheral regions (3) and (4), respectively. Thus, a specific color of ink is supplied only to the corresponding peripheral region.

The developing unit 14 and the fixing unit 15 are kept away from the periphery of the plate cylinder 17 during the printing process.

The blanket cylinder 16 is rotated with the periphery thereof brought in contact with the periphery of the plate cylinder 17 in synchronization with the rotation of the plate cylinder 17. Consequently, the ink applied on the printing plate 30 held on the plate cylinder 17 are transferred onto the blanket cylinder 16. At this time, the cleaning unit 322 is kept away from the periphery of the blanket cylinder 16.

Concurrently with the ink supplying and transferring operation, printing sheets P are taken out one by one from the sheet feeding section 25 and transported to the impression cylinder 11 via the loading unit 26. The impression cylinder 11, which holds the leading edge of a printing sheet P, rotates with the printing sheet P wound around the impression cylinder 11.

The blanket cylinder 16 is brought into contact with the impression cylinder 11. The blanket cylinder 16 and the impression cylinder 11 are rotated in synchronism. While the blanket cylinder 16 makes one turn, the impression cylinder 11 makes five turns. The ink is transferred from the printing plate 30 held on the plate cylinder 17 onto the periphery of the blanket cylinder 16. More specifically, black, cyan, magenta and yellow ink images in the four peripheral regions of the plate cylinder are transferred onto the periphery of the blanket cylinder 16. Every time the impression cylinder 11 makes one turn, the printing sheet held on the impression cylinder 11 is brought into contact with each color ink image. As a result, the ink images once transferred onto the peripheral regions of the blanket cylinder 16 are transferred onto the printing sheet. Thus, the four color ink images are sequentially transferred onto the printing sheet wound around the impression cylinder 11 and superimposed one on another in a predetermined manner, thereby achieving color printing.

The impression cylinder 11 makes four turns to bring the printing sheet into contact with the four color ink images transferred onto the blanket cylinder 16, and thereafter the sheet is transferred to the unloading unit 27.

The transfer of the sheet from the impression cylinder 11 to the unloading unit 27 is achieved in the same manner as described in the foregoing embodiments and, therefore, a detailed explanation will not be given thereto.

Figure 25:
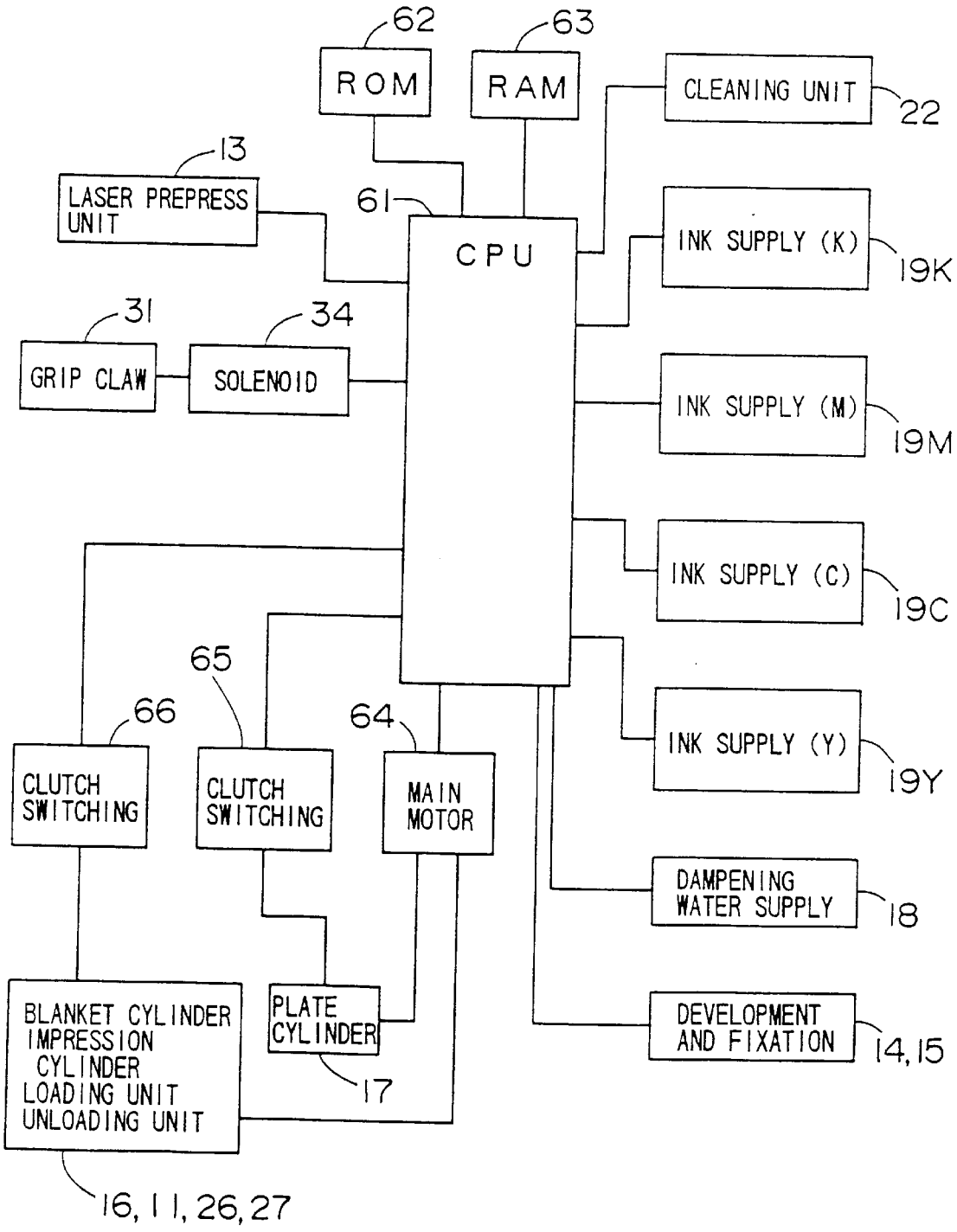
FIG. 25 is a block diagram illustrating an exemplary construction of a control circuitry according to the sixth embodiment of the present invention.

FIG. 25 is a block diagram illustrating an exemplary construction of a control circuit for the digital printer 310 shown in FIG. 24.

The digital printer 310 has a CPU 61 as a control center which is connected to a ROM 62 and a RAM 63.

The CPU 61 controls a main motor driving circuit 64 and clutch switching circuits 65 and 66. The rotation of the plate cylinder 17 is controlled by the main motor driving circuit 64 and the clutch switching circuit 65. The rotation of the blanket cylinder 16, the impression cylinder 11, the loading unit 26 and the unloading unit 27 is controlled by the main motor driving circuit 64 and the clutch switching circuit 66.

The CPU 61 is further connected to the laser prepress unit 13. The driving of the laser prepress unit 13 is controlled by the CPU 61. The CPU 61 is still further connected to a solenoid 34 for controlling the open/close of the grip claw 31 of the impression cylinder 11. The driving of the solenoid 34 is also controlled by the CPU 61.

The dampening water unit 18, the four ink supplying units 19, the developing unit 14 and the fixing unit 15 are also connected to CPU 61. On the basis of control signals from the CPU 61, these units are shifted into contact with and away from the plate cylinder 17 and operated.

It should be noted that the control circuitry shown in the block diagram of FIG. 25 is merely one example, and the control circuitry may have a different construction.

Figure 26:
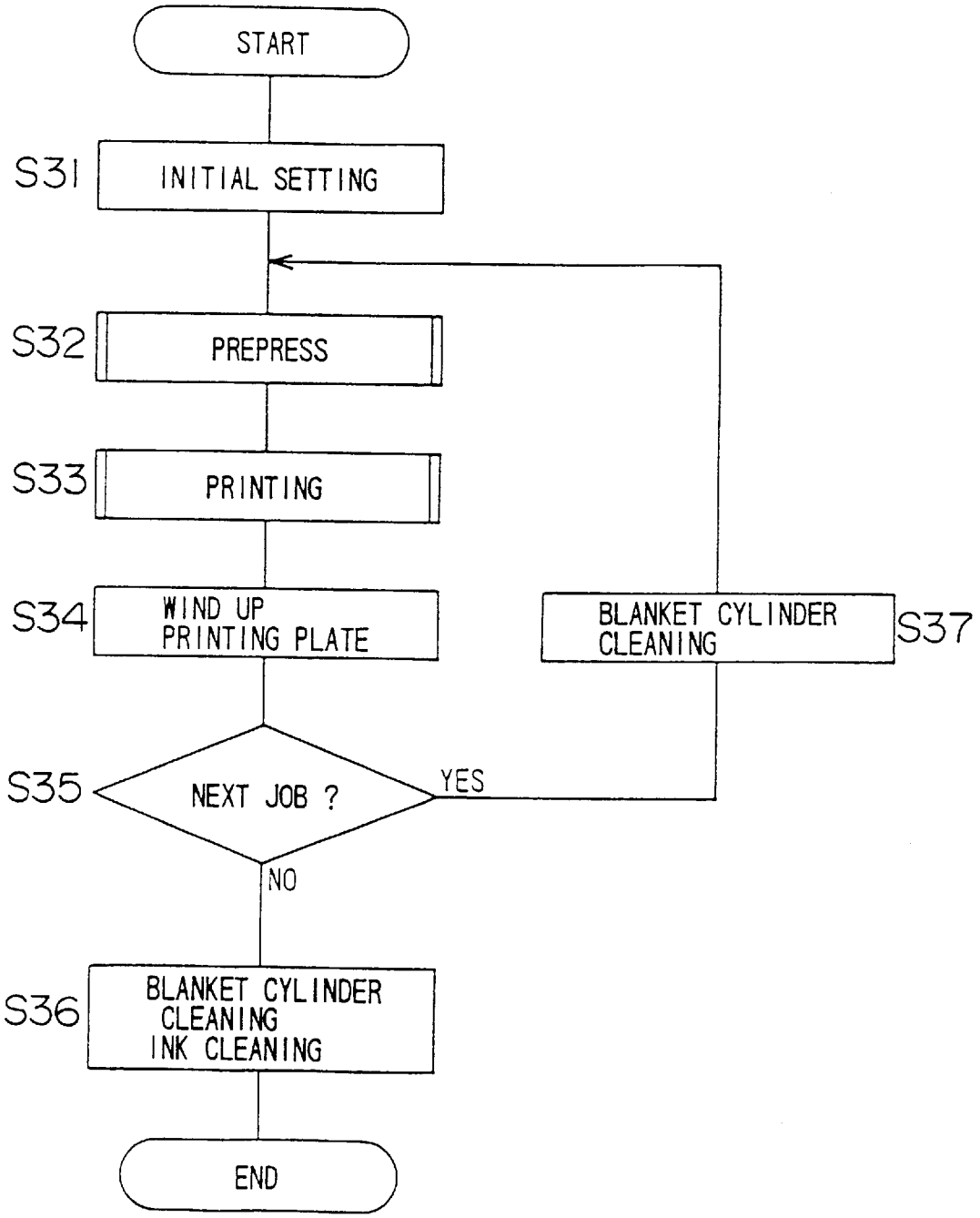
FIG. 26 is a flow chart illustrating a comprehensive control operation according to the sixth embodiment of the present invention.

FIG. 26 is a flow chart illustrating a comprehensive control operation of the digital printer 310. Following the flow of FIG. 26, an explanation will be given to the comprehensive operation of the digital printer 310.

Upon starting the control operation, an initial setting operation and the like is performed (Step S31). In the initial setting operation, for example, the plate cylinder 17, the blanket cylinder 16, the impression cylinder 11 and the like are each set at a predetermined initial angular position, and the dampening water unit 18, the ink units 19, the developing unit 14, the fixing unit 15 and the like are each set in a position apart from the plate cylinder 17. Further, work registers and the like in the RAM 63 are each cleared and placed in an initial state.

After the completion of the initial setting operation, the prepress process is performed (Step S32), which will be detailed later with reference to FIG. 27.

After the completion of the prepress process, the printing process is performed (Step S33). The digital printer 310 is characterized in that there is no need to transport the printing plate 30 after the prepress process. In the prepress process, images for the respective print colors are recorded on the printing plate 30 wound around the plate cylinder 17. The printing process is performed with the printing plate 30 kept in this state, i.e., in a state where the printing plate 30 prepared on the plate cylinder 17 is held thereon.

Since the prepress process and the printing process are performed on the plate cylinder 17, there is no need to transport the printing plate prepressed in the prepress process to a different place for the printing process. Therefore, the registration accuracy can be improved.

After the completion of the printing process, the printing plate 30 on the plate cylinders 17 is wound up (Step S34). More specifically, the printing plate 30 held around the plate cylinder 17 is wound up by the second retention member 53 of the plate supplying unit 323 in the plate cylinder 17. At the same time, the image-unrecorded printing plate 30 is drawn out from the first retention member 351 onto the periphery of the plate cylinder 17. Thus, the image-unrecorded printing plate 30 is mounted on the periphery of the plate cylinder 17 for the next cycle of the prepress process.

In turn, it is determined if there is a subsequent job to be performed (Step S35). That is, it is determined if the prepress process and the printing process are to be performed subsequently. If there is no subsequent job to be performed, the blanket cylinder 16 is cleaned (Step S37). The cleaning of the blanket cylinder 16 is achieved, for example, by rotating the blanket cylinder 16 with the cleaning unit 322 brought into contact with the periphery thereof.

If it is determined in Step S5 that no next job is to be performed, an ink cleaning operation is performed on the blanket cylinder 16 along with the aforesaid cleaning operation (Step S36). The ink cleaning operation is achieved by applying cleaning liquid onto inking rollers of the respective inking units 19 and wiping it away with blades or the like. The ink cleaning operation may be automatically performed by special cleaning units or, alternatively, may be manually performed on the basis of an indication by an indicator which identifies a need for the ink cleaning operation.

Figure 27:
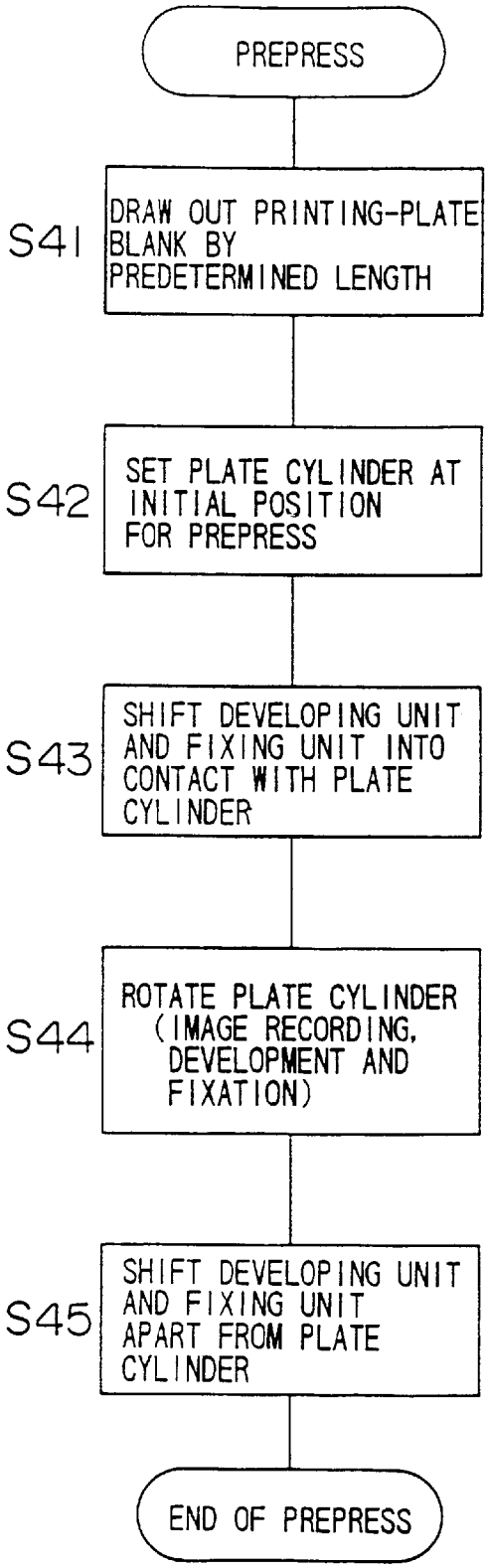
FIG. 27 is a flow chart illustrating in detail a control operation for a prepress process in accordance with the sixth embodiment.

The control operation in the prepress process shown in FIG. 27 is directed to a case where a resin sheet formed with a silver salt photosensitive layer is used as the plate blank 36.

In the prepress process, the image-unrecorded printing plate 30 is drawn out from the first retention member 351 in the plate supplying unit 323 (see FIG. 24). The drawn-out printing plate 30 is wound around the plate cylinder 17. The previously used printing plate 30 on the periphery of the plate cylinder 17 is taken up in the second retention member 53 in synchronization with the drawing-out of the image-unrecorded printing plate 30 from the first retention member 351. Thus, the previously used printing plate 30 on the plate cylinder 17 is replaced with the image-unrecorded printing plate (Step S41).

Subsequently, the plate cylinder 17 is rotated through a predetermined angle to the initial angular position (Step S42). Since the setting of the initial angular position has already been explained with reference to FIG. 24, a repeated explanation is omitted.

In turn, the developing unit 14 and the fixing unit 15 are each shifted to the position in contact with the periphery of the plate cylinder 17 (Step S43).

Then, the plate cylinder 17 is rotated and, in synchronization therewith, images for the respective print colors are recorded on the image-unrecorded printing plate 30 on the periphery of the plate cylinder 17 by means of the laser prepress unit 13. The recorded images are developed by the developing unit 14 and fixed by the fixing unit 15 (Step S44).

Upon completion of the image recording on the printing plate 30 wound around the plate cylinder 17, the developing unit 14 and the fixing unit 15 are shifted away from the periphery of the plate cylinder 17 (Step S45).

Thus, the prepress process is completed.

Figure 28:
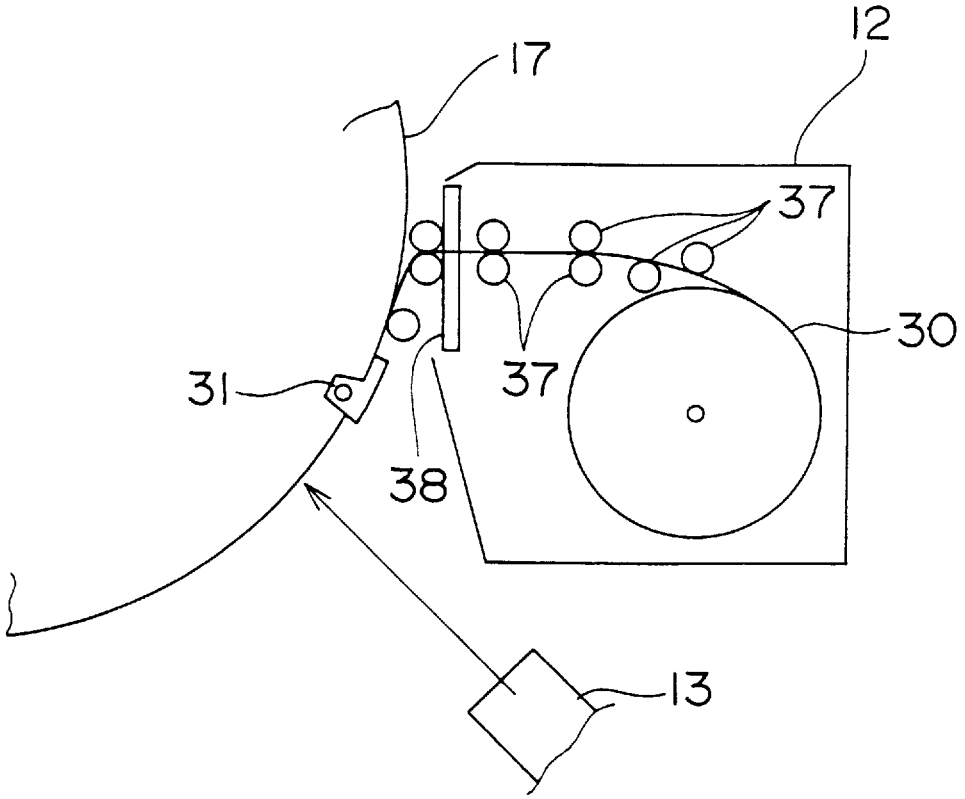
FIG. 28 is a schematic partial diagram illustrating a digital printer according to a seventh embodiment of the present invention.

FIG. 28 is a schematic partial diagram illustrating a modification of the digital printer 310. In the digital printer 310 described with reference to FIG. 24, the plate supplying unit 323 is provided in the plate cylinder 17. The provision of the plate supplying unit 323 in the plate cylinder 17, as shown in FIG. 24, allows the printing plate 30 to be continuously drawn out and wound around the plate cylinder 17.

However, the construction shown in FIG. 28 is such that a plate supplying cassette 12 is provided in a predetermined position adjacent to the periphery of the plate cylinder 17 not within the plate cylinder 17.

The construction and operation of the plate supplying cassette 12 will be described with reference to FIG. 28. A rolled printing plate 30 yet to be subjected to image recording is accommodated in the plate supplying cassette 12. A resin sheet formed with a silver salt photosensitive layer, for example, is used as the printing plate 30. The printing plate 30 accommodated in the plate supplying cassette 12 is drawn out therefrom by means of a plurality of rollers 37 provided in the cassette 12. The leading edge of the printing plate 30 is held by a grip claw 31 of the plate cylinder 17 (which may have the same construction as the grip claw 31 of the impression cylinder 11 previously described). As the plate cylinder 17 is rotated clockwise in this state, the printing plate 30 is wound around the plate cylinder 17. When the printing plate 30 is drawn out by a predetermined length, a cutter 38 provided in the plate supplying cassette 12 is actuated. Thus, the printing plate 30 is cut to a length corresponding to the length of a color image. The trailing edge of the cut printing plate 30 is held by a suction mechanism (not shown) provided in the plate cylinder 17.

The aforesaid operation is repeated, whereby a predetermined number of printing plates 30 (e.g., four printing plates) are held on the periphery of the plate cylinder 17.

With the arrangement shown in FIG. 28, by preparing separate printing plates for the respective print color images, a printing-plate blank can be used without waste for.

The features disclosed in the foregoing description, in the following claims and/or in the accompany drawings may, separately and in any combination thereof, be material for realizing the invention in diverse forms thereof.

Although the aforesaid embodiments employ a silver salt-based material as the photosensitive material and ink for printing, other photosensitive materials such as electrophotosensitive materials, and toner may be as a pigment material. Further, although the aforesaid embodiments are directed to four-color-based printers, the present invention can be applied to two-color-based printers and multi-color-based printers utilizing more than four colors.

What is claimed is:

1. A digital printer integrally incorporating a prepress mechanism and a printing mechanism and adapted to form an image on at least one printing plate on the basis of image data and then print the image on a printing sheet using the printing plate, the digital printer comprising:

at least two plate cylinders each for holding at least one printing plate, the plate cylinders being used in a printing process;

at least two ink supplying devices each for supplying a predetermined ink to a respective one of the printing plates held by the plate cylinders, the ink supplying devices being used in the printing process;

at least two rotatable blanket cylinders each in contact with a respective one of the plate cylinders for receiving the ink transferred thereon from the respective printing plate, the blanket cylinder being used in the printing process;

a rotatable impression cylinder in contact with the blanket cylinders for transporting a printing sheet on the periphery thereof and transferring the ink from the blanket cylinders onto the printing sheet, the impression cylinder being used in the printing process;

a support device for supporting a blank printing plate, the support device being used in a prepress process; and a prepress mechanism for recording an image corresponding to a print color on the printing plate supported by the support device, the prepress mechanism being commonly associated with at least two of the plate cylinders and corresponding printing plates.

2. The digital printer as set forth in claim 1, further comprising a transportation mechanism for transporting the printing plates, having images recorded thereon by the prepress mechanism, from the support device to the plate cylinder.

3. The digital printer as set forth in claim 2, wherein the impression cylinder serves as the support device.

4. The digital printer as set forth in claim 3, wherein the impression cylinder has a clamp device provided at a predetermined position of the periphery thereof, the clamp device being used as a clamp for holding the printing plates and for holding the printing sheet, the clamp device being adapted to clamp respective leading edges of the printing plates in the prepress process and to clamp a leading edge of the printing sheet.

5. The digital printer as set forth in claim 4, further comprising a printing-plate supplying mechanism provided adjacent to the impression cylinder for supplying the blank printing plate onto the impression cylinder, the printing-plate supplying mechanism being used in the prepress process.

6. The digital printer as set forth in claim 5, wherein the prepress mechanism comprises a laser prepress device.

7. The digital printer as set forth in claim 4, wherein the clamp device is adapted such that it does not project from the periphery of the impression cylinder when it is in a closed state.

8. The digital printer as set forth in claim 3, wherein after images are recorded on the printing plates supported by the impression cylinder serving as the support device, the transportation mechanism transports the image-recorded printing plates from the impression cylinder to the plate cylinder via the blanket cylinder.

9. The digital printer as set forth in claim 8, wherein the transportation mechanism comprises printing-plate transfer mechanisms respectively provided in the blanket cylinder and the plate cylinder.

10. The digital printer as set forth in claim 9, wherein the printing-plate transfer mechanisms comprise clamp devices respectively provided on the peripheries of the blanket cylinder and the plate cylinder for clamping leading edges of the printing plates.

11. The digital printer as set forth in claim 10, wherein the clamp devices are adapted not such that they do project from the peripheries of the blanket cylinder and the plate cylinder when they are in a closed state.

12. The digital printer as set forth in claim 3, wherein the transportation mechanism comprises a printing-plate transfer mechanism for transferring the image-recorded printing plates supported by the impression cylinder directly to the plate cylinders.

13. The digital printer as set forth in claim 2, wherein the support device comprises a prepress cylinder for holding the printing plates on the periphery thereof.

14. The digital printer as set forth in claim 2, wherein the support device comprises a transportation mechanism for transporting the printing plates along a predetermined transportation path.

15. The digital printer as set forth in claim 13, wherein the support device supports a plurality of printing plates at one time.

16. The digital printer as set forth in claim 2, wherein the transportation mechanism is adapted to transport the printing plates from the support device to the plate cylinders via the impression cylinder.

17. The digital printer as set forth in claim 2, wherein the transportation mechanism is adapted to transport the printing plates from the support device directly to the plate cylinders.

18. A digital printer as set forth in claim 16, wherein the transportation mechanism comprises a suction guide device for engaging leading edges of the printing plates supported by the support device and guiding the leading edges of the printing plates to a transfer destination.

19. A digital printer integrally incorporating a prepress mechanism and a printing mechanism and adapted to form an image on a printing plate on the basis of image data and then print the image on a printing sheet using the printing plate, the digital printer comprising:

at least one plate cylinder having a number of printing regions formed on its periphery for two or more print colors, the plate cylinder for holding a plurality of printing plates;

a plurality of ink supplying devices for supplying predetermined ink to the printing plates held on the printing regions of the plate cylinder, the ink supplying devices being used in the printing process;

a rotatable blanket cylinder in contact with the plate cylinder and having a number transferring regions equal to the number of printing regions formed on the plate cylinder, the rotatable blanket cylinder for receiving the ink transferred thereon from the printing plate, the blanket cylinder being used in the printing process;

a rotatable impression cylinder in contact with the blanket cylinder for transporting a printing sheet on the periphery thereof and transferring the ink from the blanket cylinder onto the printing sheet, the impression cylinder being used in the printing process;

a printing plate supplying mechanism for supplying blank printing plates to each of the printing regions of the plate cylinder; and a prepress mechanism for recording an image corresponding to a print color on a plurality of the printing plates supported by a common plate cylinder, the prepress mechanism being commonly associated with the printing plates held on the plate cylinder.

20. The digital printer as set forth in claim 19, wherein said prepress mechanism comprises a laser prepress device and a developing unit, said developing unit being adapted to make contact with and move away from the printing plate.

21. A digital printer integrally incorporating a prepress mechanism and a printing mechanism and adapted to form an image on a printing plate on the basis of image data and then print the image on a printing sheet using the printing plate, the digital printer comprising:

at least one plate cylinder having a number of printing regions formed on its periphery for two or more print colors, the plate cylinder for holding a continuous printing plate having a number of recording regions equal to the number of printing regions formed on the plate cylinder;

a plurality of ink supplying devices for supplying predetermined ink to the recording regions of the printing plate, the ink supplying devices being used in the printing process;

a rotatable blanket cylinder in contact with the plate cylinder and having a number of transferring regions equal to the number of printing regions formed on the plate cylinder, the rotatable blanket cylinder for receiving the ink transferred thereon from the printing plate, the blanket cylinder being used in the printing process;

a rotatable impression cylinder in contact with the blanket cylinder for transporting a printing sheet on the periphery thereof and transferring the ink from the blanket cylinder onto the printing sheet, the impression cylinder being used in the printing process;

a printing plate supplying mechanism for supplying a blank printing plate to the plate cylinder, the blank printing plate being the continuous printing plate; and a prepress mechanism for recording an image corresponding to a print color on the recording regions provided on the printing plate, the prepress mechanism being commonly associated with each of the recording regions on the printing plate.

22. The digital printer as set forth in claim 21, wherein said prepress mechanism comprises a laser prepress device and a developing unit, said developing unit being adapted to make contact with and move away from the printing plate.

23. A digital printer, comprising:

a support device on which at least one blank printing plate is disposed;

a single prepress mechanism which records an image on each of the blank printing plates to produce exposed printing plates;

at least two plate cylinders on which at least one of the exposed printing plates is disposed;

a delivery mechanism which delivers the exposed printing plates to each of the plate cylinders from the support device;

at least two pigment sources each of which provides pigment for disposal on areas of one of the exposed printing plates corresponding to the image thereon;

at least two blanket cylinders adapted to respectively contact corresponding plate cylinders and receive the pigment therefrom; and an impression cylinder operatively engageable with all the blanket cylinders, the impression cylinder having at least one printing sheet disposed thereon for receiving pigment from all the blanket cylinders.

24. The digital printer of claim 23, further comprising a single source of blank printing plates from which the blank printing plates are transferred to the support device.

25. The digital printer of claim 23, wherein the single repress mechanism is a laser prepress unit and the printing plates include a photosensitive material which is responsive to the laser prepress unit, and further comprising;

a developing unit containing developing material, the developing unit being adjustably engageable with the exposed printing plates for developing the photosensitive material thereon.

26. The digital printer of claim 23, wherein the single repress mechanism is a high power laser output prepress unit having a plurality of laser units thereon and the printing plates include a photosensitive material which is responsive to the high power laser output prepress unit and which does not require developing.

27. The digital printer of claim 23, wherein the support device is the impression cylinder.

28. The digital printer of claim 27, wherein:

the impression cylinder is adapted to draw a blank printing plate onto an outer surface thereof for exposure by the single prepress mechanism;

the impression cylinder is further adapted to selectively deliver the exposed printing plate to an outer surface of the blanket cylinders; and each of the blanket cylinders being adapted to deliver the exposed printing plate to an outer surface of the corresponding plate cylinder.

29. A digital printer, comprising:

a printing plate source for storing blank printing plates;

at least two plate cylinders on which at least one of the printing plates is disposed;

a delivery unit through which at least one of the blank printing plates is selectively transferred to one of the plate cylinders from the printing plate source;

a common prepress mechanism which records an image on each of the blank printing plates to produce exposed printing plates while the blank printing plate is delivered by the delivery unit;

at least two pigment sources each of which provides pigment for disposal on areas of one of the exposed printing plates corresponding to the image thereon;

at least two blanket cylinders adapted to contact at least one of the exposed printing plates on the corresponding plate cylinder and receiving the pigment therefrom; and an impression cylinder operatively engageable with all the blanket cylinders, the impression cylinder having at least one printing sheet disposed thereon for receiving pigment from all the blanket cylinders.

30. A digital printer, comprising:

a plate cylinder having an outer surface on which a blank, single sheet, printing plate is disposed;

a prepress mechanism which records at least two images on regions of the blank printing plate to produce an exposed printing plate;

at least two pigment sources each of which provides pigment for disposal on one of the regions of the exposed printing plate corresponding to the image thereon;

a blanket cylinder adapted to contact the exposed printing plate on the plate cylinder and receiving the pigment therefrom; and an impression cylinder operatively engageable with the blanket cylinder, the impression cylinder having at least one printing sheet disposed thereon for receiving pigment from the blanket cylinder.

31. The digital printer of claim 30, wherein the repress mechanism is a laser prepress unit and the printing plate includes a photosensitive material thereon which is responsive to the laser prepress unit and further comprising a developing unit containing developing material, the developing unit being adjustable engageable with the exposed printing plate for developing the photosensitive material thereon.

32. The digital printer of claim 30, further comprising:

at least one source of water for delivering water to the printing plate on the plate cylinder, the source of water being movable such that it is contactable with the printing plate;

a plurality of pigment sources for delivering pigment to respective regions of the printing plate on the plate cylinder, the pigment sources being movable such that they are selectively contactable with the regions of the printing plate.

* * * * *